US011397012B2

(12) United States Patent
Kadu et al.

(10) Patent No.: US 11,397,012 B2
(45) Date of Patent: Jul. 26, 2022

(54) PANEL RESTRICTOR FOR HVAC SYSTEM

(71) Applicant: Johnson Controls Technology Company, Auburn Hills, MI (US)

(72) Inventors: Bhushan C. Kadu, Pune (IN); Ravindra B. Salunkhe, Satara (IN); Makrand N. Yarolkar, Sanquelim (IN); Shridhar V. Vernekar, Sirsi (IN); Yogesh P. Kamat, Pune (IN); Vijay A R, Bengaluru (IN)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 178 days.

(21) Appl. No.: 16/733,133

(22) Filed: Jan. 2, 2020

(65) Prior Publication Data

US 2021/0207821 A1 Jul. 8, 2021

(51) Int. Cl.

| | |
|---|---|
| ***E05D 7/00*** | (2006.01) |
| ***F24F 1/56*** | (2011.01) |
| ***E05C 1/00*** | (2006.01) |

(52) U.S. Cl.

CPC . *F24F 1/56* (2013.01); *E05C 1/00* (2013.01)

(58) Field of Classification Search

CPC .... F24F 1/56; E05C 17/38; E05C 1/00; F28F 2280/00; E04B 1/14; F25D 23/063

USPC ..... 49/397

See application file for complete search history.

(56) References Cited

U.S. PATENT DOCUMENTS

| | | | | |
|---|---|---|---|---|
| 1,132,412 A | 3/1915 | Weder, Sr. et al. | | |
| 2,201,594 A | 5/1940 | Sitts | | |
| 6,176,040 B1 * | 1/2001 | Sugihara | E05C 17/206 | 49/394 |
| 6,520,551 B1 * | 2/2003 | Crnkovich | E05C 17/047 | 292/288 |
| 2003/0011289 A1 * | 1/2003 | Adams | F24F 13/20 | 312/265.1 |
| 2018/0155969 A1 * | 6/2018 | Mislak | E05B 65/006 | |
| 2019/0112850 A1 * | 4/2019 | D'Souza | E05C 17/08 | |

FOREIGN PATENT DOCUMENTS

| | | |
|---|---|---|
| CN | 203113970 U | 8/2013 |
| CN | 204225648 U | 3/2015 |
| CN | 205213188 U | 5/2016 |
| CN | 205429462 U | 8/2016 |
| CN | 107217932 A | 9/2017 |

(Continued)

OTHER PUBLICATIONS

Attached pdf file is translation of foreign reference CN207739804U (Year: 2018).*

*Primary Examiner* — Henry T Crenshaw

*Assistant Examiner* — Kamran Tavakoldavani

(74) *Attorney, Agent, or Firm* — Fletcher Yoder, P.C.

(57) ABSTRACT

A panel restrictor for a heating, ventilation, and/or air conditioning (HVAC) unit includes a first bracket configured to couple to a structural support of the HVAC unit, where the first bracket includes a slot. The panel restrictor includes a second bracket configured to couple to a panel of the HVAC unit. An arcuate segment extends from the second bracket and is configured to extend through the slot. The panel restrictor also includes an engager configured to secure the arcuate segment within the slot at a plurality of discrete positions along the arcuate segment.

23 Claims, 21 Drawing Sheets

(56) References Cited

FOREIGN PATENT DOCUMENTS

| | | | | | |
|---|---|---|---|---|---|
| CN | 207228856 | U | | 4/2018 | |
| CN | 207363464 | U | | 5/2018 | |
| CN | 207739804 | U | * | 8/2018 | ..... E05C 17/04 |

* cited by examiner

PANEL RESTRICTOR FOR HVAC SYSTEM

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

HVAC systems are utilized in residential, commercial, and industrial environments to control environmental properties, such as temperature and humidity, for occupants of the respective environments. The HVAC system may include one or more heat exchangers, blowers, compressors, and/or a variety of other HVAC components that facilitate regulating such environmental properties through control of an air flow delivered to the environment. The HVAC components are typically positioned within an enclosure of the HVAC system that is configured to shield the HVAC components from direct exposure to precipitation, ultraviolet radiation, and/or other environmental elements.

Generally, HVAC enclosures may be assembled from a plurality of panel assemblies that are coupled to a frame or to another support structure of the HVAC enclosure. Certain of the panel assemblies may be pivotably coupled to the frame via one or more hinges that enable the panel assemblies to transition between respective open and closed positions. As such, the panel assemblies may selectively enable access to the HVAC components positioned within an interior of the HVAC enclosure for maintenance or other purposes. Unfortunately, the panel assemblies may be susceptible to movement during performance of such maintenance operations and may not remain stationary in the open or closed positions.

SUMMARY

The present disclosure relates to a panel restrictor for a heating, ventilation, and/or air conditioning (HVAC) unit. The panel restrictor includes a first bracket configured to couple to a structural support of the HVAC unit, where the first bracket includes a slot. The panel restrictor includes a second bracket configured to couple to a panel of the HVAC unit. An arcuate segment extends from the second bracket and is configured to extend through the slot. The panel restrictor also includes an engager configured to secure the arcuate segment within the slot at a plurality of discrete positions along the arcuate segment.

The present disclosure also relates to a heating, ventilation, and/or air conditioning (HVAC) unit. The HVAC unit includes a panel pivotably coupled to a structural support of the HVAC unit and a panel restrictor configured to retain the panel in a plurality of orientations relative to the structural support. The panel restrictor includes a first bracket coupled to the structural support, where the first bracket includes a slot. The panel restrictor also includes a second bracket coupled to the panel and including an arcuate segment extending through the slot. The panel restrictor further includes an engager configured to secure the arcuate segment within the slot at a plurality of discrete positions along the arcuate segment, where each of the plurality of discrete positions corresponds to one of the plurality of orientations of the panel.

The present disclosure also relates to a door assembly of a heating, ventilation, and/or air conditioning (HVAC) unit. The door assembly includes a panel configured to occlude an opening of the HVAC unit and a hinge pivotably coupling the panel to a structural support of the HVAC unit. The hinge enables pivotal motion of the panel about an axis relative to the structural support. The door assembly includes a panel restrictor configured to retain the panel in a plurality of orientations relative to the structural support. The panel restrictor includes a first bracket coupled to the structural support, where the first bracket includes a slot. The panel restrictor also includes a second bracket coupled to the panel and including an arcuate segment configured to extend through the slot, where the arcuate segment includes a plurality of apertures formed therein. The panel restrictor also includes an engager coupled to the first bracket and configured to engage with an aperture of the plurality of apertures to secure the first bracket to the second bracket at a discrete position along the arcuate segment, where the discrete position corresponds to one of the plurality of orientations of the panel.

DETAILED DESCRIPTION

Figure 1:
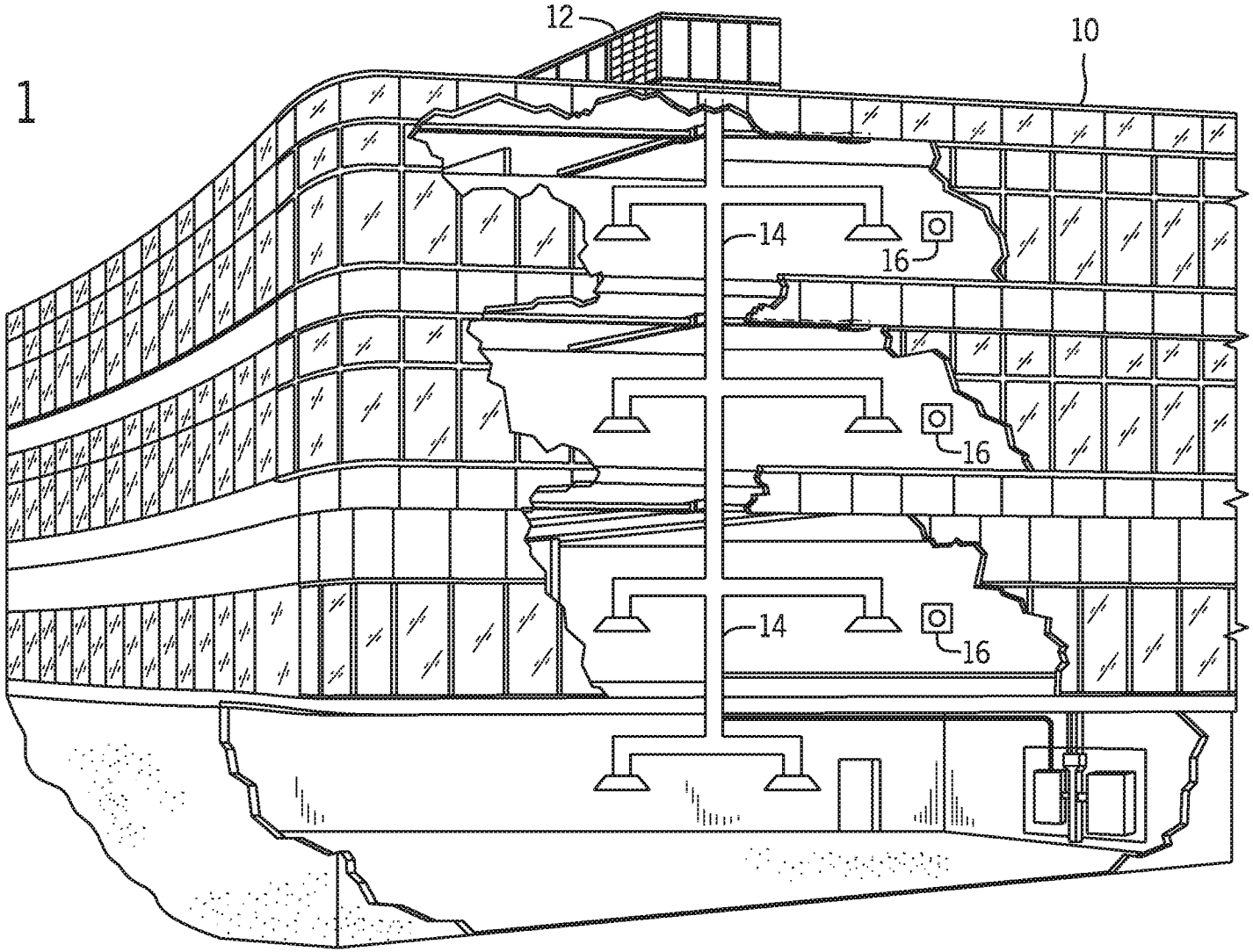
FIG. 1 is a perspective view of an embodiment of a building that may utilize a heating, ventilation, and/or air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

A heating, ventilation, and/or air conditioning (HVAC) system may be used to thermally regulate a space within a building, home, or other suitable structure. The HVAC system generally includes a vapor compression system that transfers thermal energy between a heat transfer fluid, such as a refrigerant, and a fluid to be conditioned, such as air. The vapor compression system typically includes a condenser and an evaporator that are fluidly coupled to one another via conduits to form a refrigerant circuit. A compressor of the refrigerant circuit may be used to circulate the refrigerant through the conduits and enable the transfer of thermal energy between the condenser and the evaporator.

The HVAC system generally includes an enclosure that may house certain HVAC components of the HVAC system, such as the evaporator and the compressor. As such, the enclosure may shield the HVAC components from direct exposure to precipitation, ultraviolet radiation, and/or other environmental elements surrounding the HVAC system. Moreover, the enclosure may define a flow path that enables a blower or fan to force an air flow along the flow path and across the evaporator during operation of the HVAC system. As such, the enclosure enables the blower to facilitate heat exchange between the air flow and the refrigerant circulating through the refrigerant circuit. Accordingly, the evaporator may output a flow of conditioned air that may be discharged from the enclosure and directed to a suitable room or space within the building.

The HVAC enclosure is typically formed from a plurality of panel assemblies that are coupled to a frame or to another support structure of the HVAC enclosure. As briefly discussed above, certain of the panel assemblies may be pivotably coupled to the frame via one or more hinges that enable the panel assemblies to rotate about respective axis between corresponding closed and open positions. As such, a service technician or other operator of the HVAC system may selectively transition the panel assemblies between the closed and open positions to obtain access to an interior of the HVAC enclosure. In this manner, the movable panel assemblies may facilitate performance of maintenance or inspection operations on the HVAC components positioned within the HVAC enclosure.

Unfortunately, conventional hinge assemblies may be unable the effectively retain the panel assemblies in particular positions, such as the open positions, when forces generated due to wind or other sources are imparted on the panel assemblies. As a result, the panel assemblies may not remain oriented in desired positions, and thus, may complicate maintenance operations on the HVAC system and increase a time period that may be involved to complete the maintenance operations.

It is now recognized that retaining a panel or a panel assembly of an HVAC enclosure in a particular position may enable personnel to more easily obtain access to an interior of the HVAC enclosure. More specifically, it is now recognized that retaining a panel assembly in an open position may enable personnel to access an interior of an HVAC enclosure without having to stabilize the panel assembly or otherwise manually retain the panel assembly in the open position.

Accordingly, embodiments of the present disclosure are directed to a panel restrictor that is configured to retain a panel assembly of an HVAC enclosure in various discrete positions or orientations relative to a frame of the HVAC enclosure. For example, in some embodiments, the panel restrictor may include a first end that is coupled to the frame or to another structural support of the HVAC enclosure and a second end that is coupled to the panel assembly. The panel restrictor may be selectively lockable in a plurality of positions to retain the panel assembly in an open position or in various partially open positions. As such, when in a locked configuration, the panel restrictor may ensure that the panel assembly remains substantially stationary relative to the HVAC enclosure and may inhibit movement of the panel assembly due forces generated by, for example, wind and/or gravity. These and other features will be described below with reference to the drawings.

It is important to note that, while the present disclosure describes the panel restrictor as configured for use with an enclosure of an HVAC system, it should be appreciated that the disclosed embodiments may be implemented with a variety of other enclosures, housings, and electrical boxes having various movable panels, doors, and/or access hatches. As a non-limiting example, the techniques described herein may be used with enclosures, doors, and/or panel assemblies used in automotive, marine, and/or aeronautical industries.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
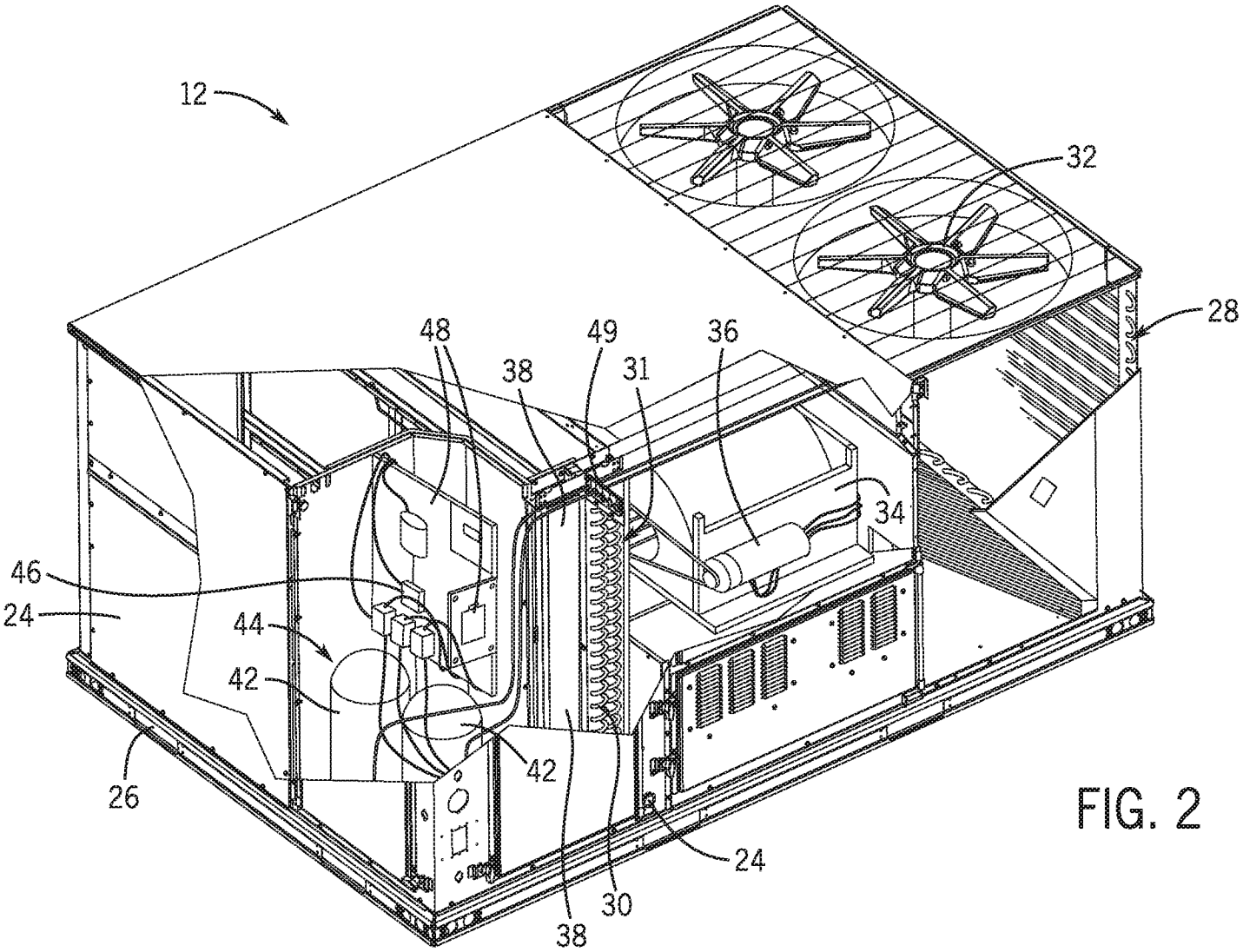
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
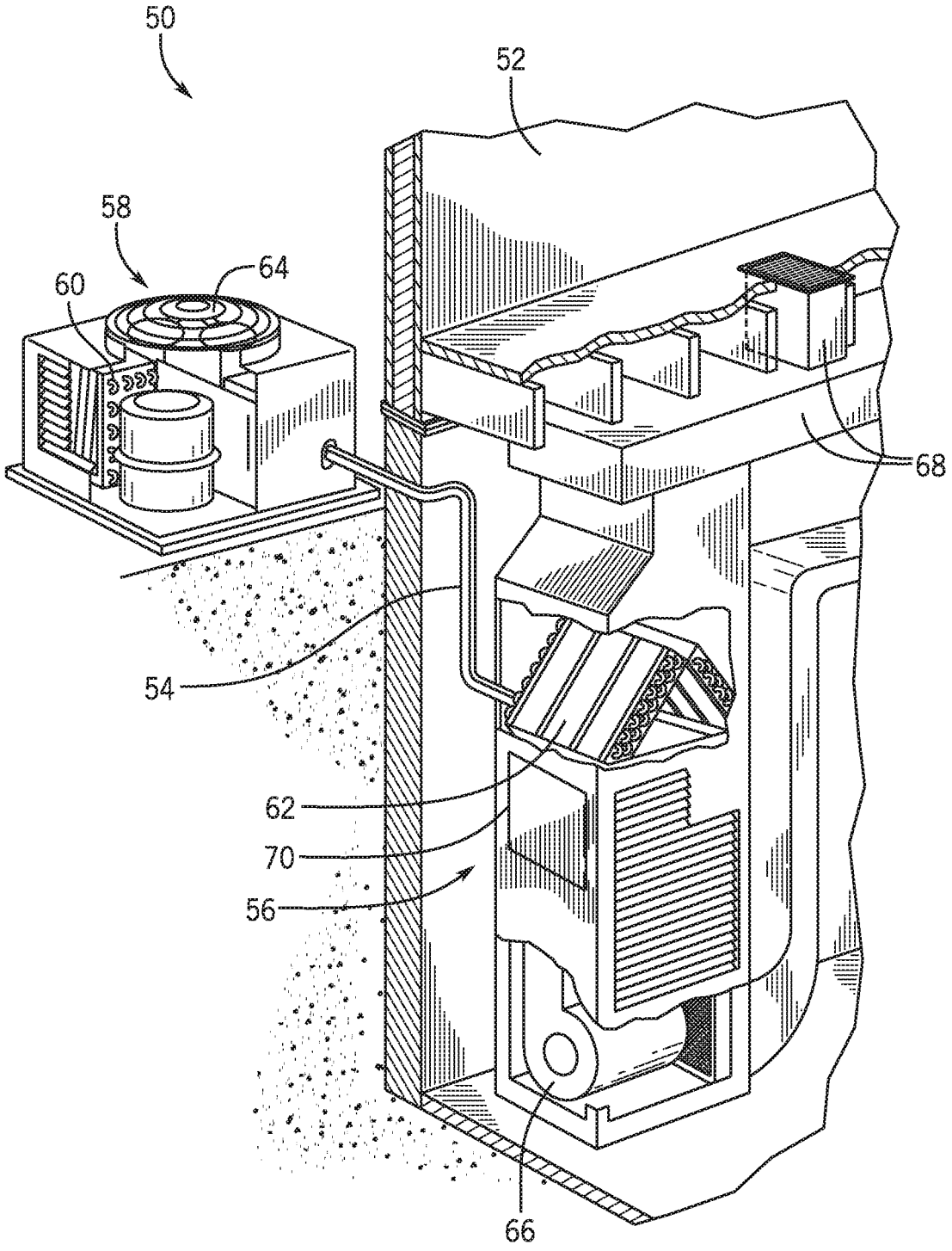
FIG. 3 is a perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
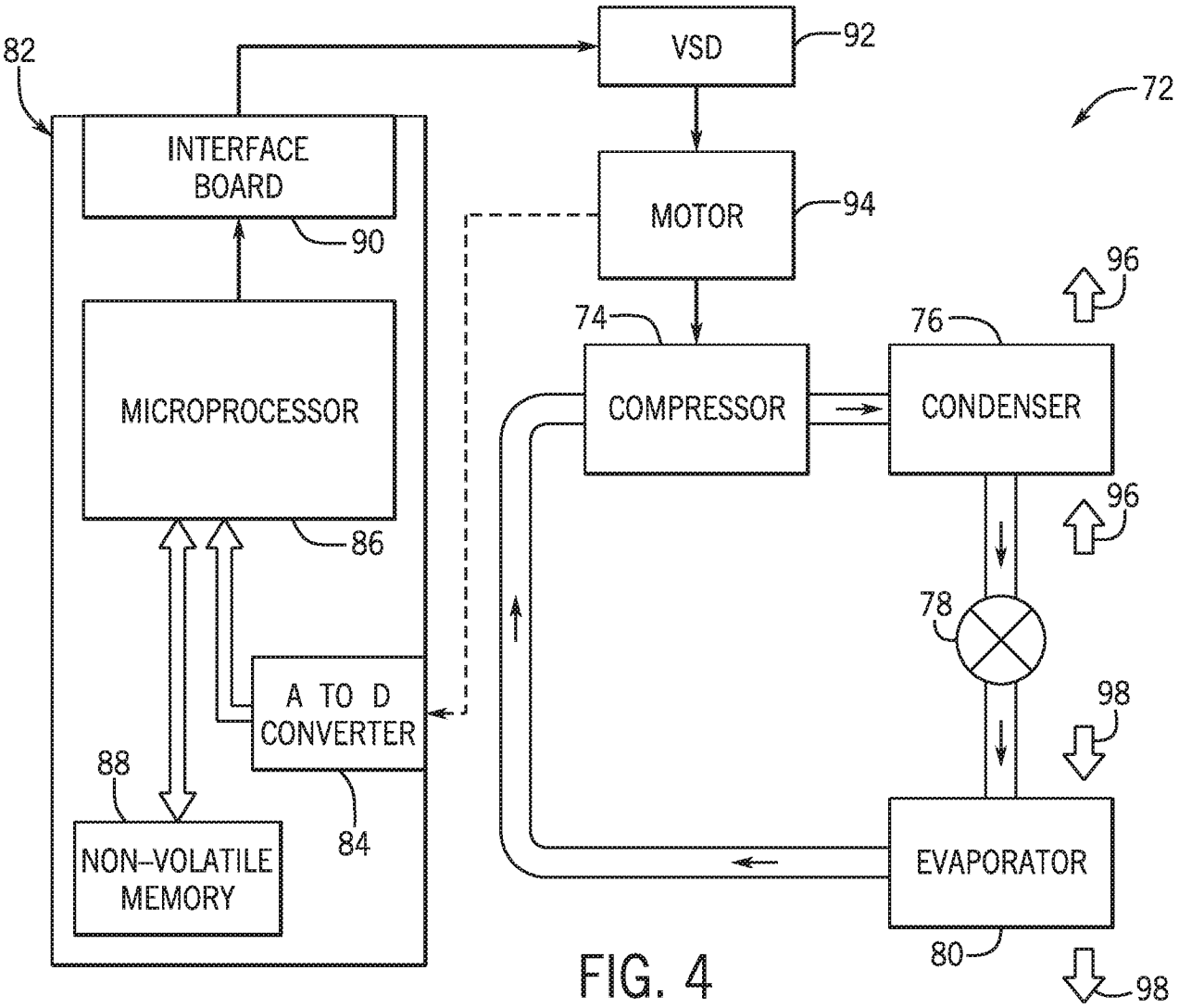
FIG. 4 is a schematic diagram of an embodiment of a vapor compression system that may be used in an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Figure 5:
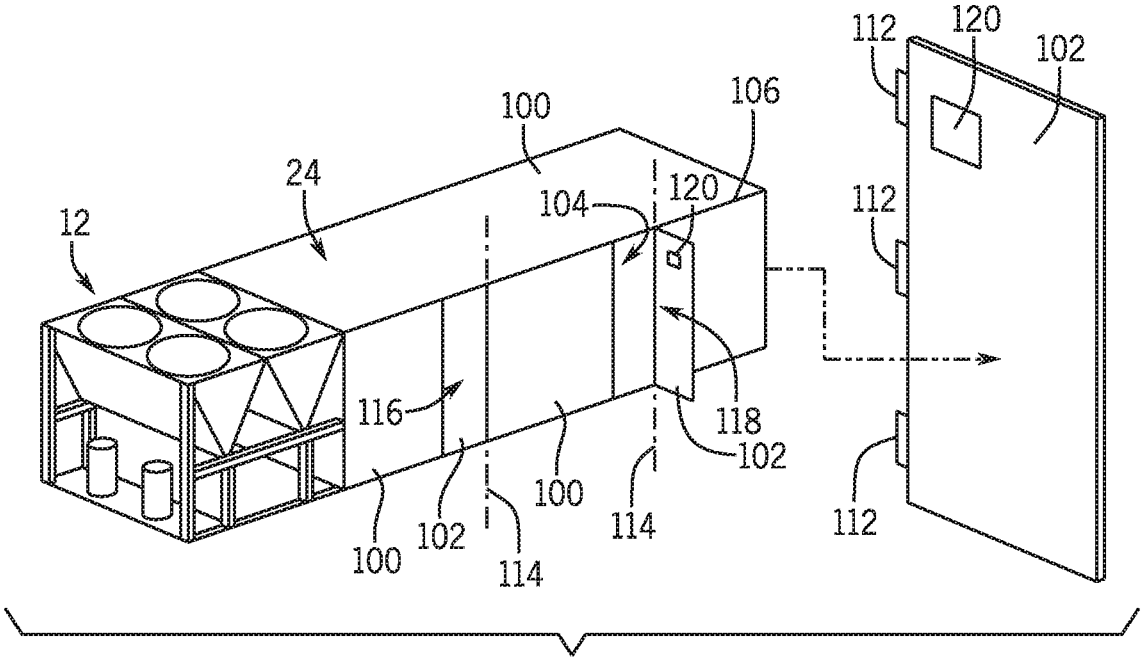
FIG. 5 is a perspective view of an embodiment of an HVAC unit having pivotable panel assemblies, in accordance with an aspect of the present disclosure.

As noted above, HVAC enclosures may be configured to house a variety of HVAC components to shield the HVAC components from exposure to precipitation, ultraviolet radiation, and/or other environmental elements. For example, to provide context for the following discussion, FIG. 5 is a perspective view of an embodiment of the HVAC unit 12. As shown in the illustrated embodiment, the cabinet 24 may include a plurality of walls 100 and a plurality of panel assemblies 102 or doors that cooperate to enclose or partially enclose an interior volume 104 that is suitable for housing a compressor, an evaporator, and/or any other suitable HVAC component of the HVAC unit 12. In some embodiments, the plurality of walls 100 may be fixedly coupled to a frame 106 of the HVAC unit 12 or to another suitable support structure of the HVAC unit 12. The plurality of panel assemblies 102 may be pivotably coupled to the frame 106 and movable relative to the frame 106 to selectively enable access to the interior volume 104 of the cabinet 24. As such, a service technician or other operator may access HVAC components that are housed within the cabinet 24 for inspection, maintenance, or other purposes.

For example, one or more hinge assemblies 112 or hinges may be configured to pivotably couple the panel assemblies 102 to the frame 106. The hinge assemblies 112 enable the panel assemblies 102 to pivot about respective axes 114 relative to the frame 106. As such, the panel assemblies 102 may be transitionable between respective closed positions 116, in which the panel assemblies 102 block access to the interior volume 104, and respective open positions 118, in which the panel assemblies 102 enable access to the interior volume 104. That is, in the closed positions 116, the panel assemblies 102 may occlude respective openings of the cabinet 24 that provide access to the interior volume 104. As noted above, it may be desirable to retain certain of the panel assemblies 102 in particular positions, such as in various open positions, while a service technician is performing an inspection and/or maintenance operation on the HVAC unit 12. Accordingly, the panel assemblies 102 of the illustrated embodiment are equipped with respective panel restrictors 120 that, as discussed in detail below, may be configured to selectively retain the panel assemblies 102 in the closed positions 116, in the open positions 118, or in a variety of partially open positions. It should be appreciated that embodiments of the panel restrictors 120 discussed herein may be implemented in embodiments or components of the split residential heating and cooling system 50 shown in FIG. 3, a rooftop unit (RTU), or any other suitable air handling unit or HVAC system. Indeed, it should be understood that the panel restrictors 120 may be configured to retain any suitable doors, panels, hatches, or access covers in particular positions, in accordance with the techniques discussed herein.

Figure 6:
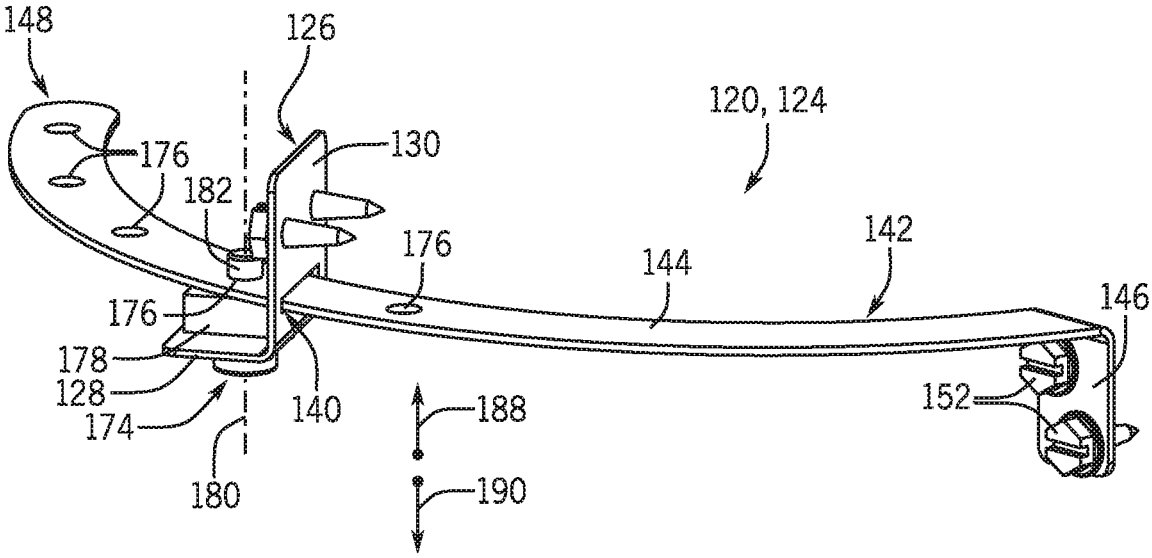
FIG. 6 is a perspective view of an embodiment of a panel restrictor for an HVAC unit, in accordance with an aspect of the present disclosure.
Figure 7:
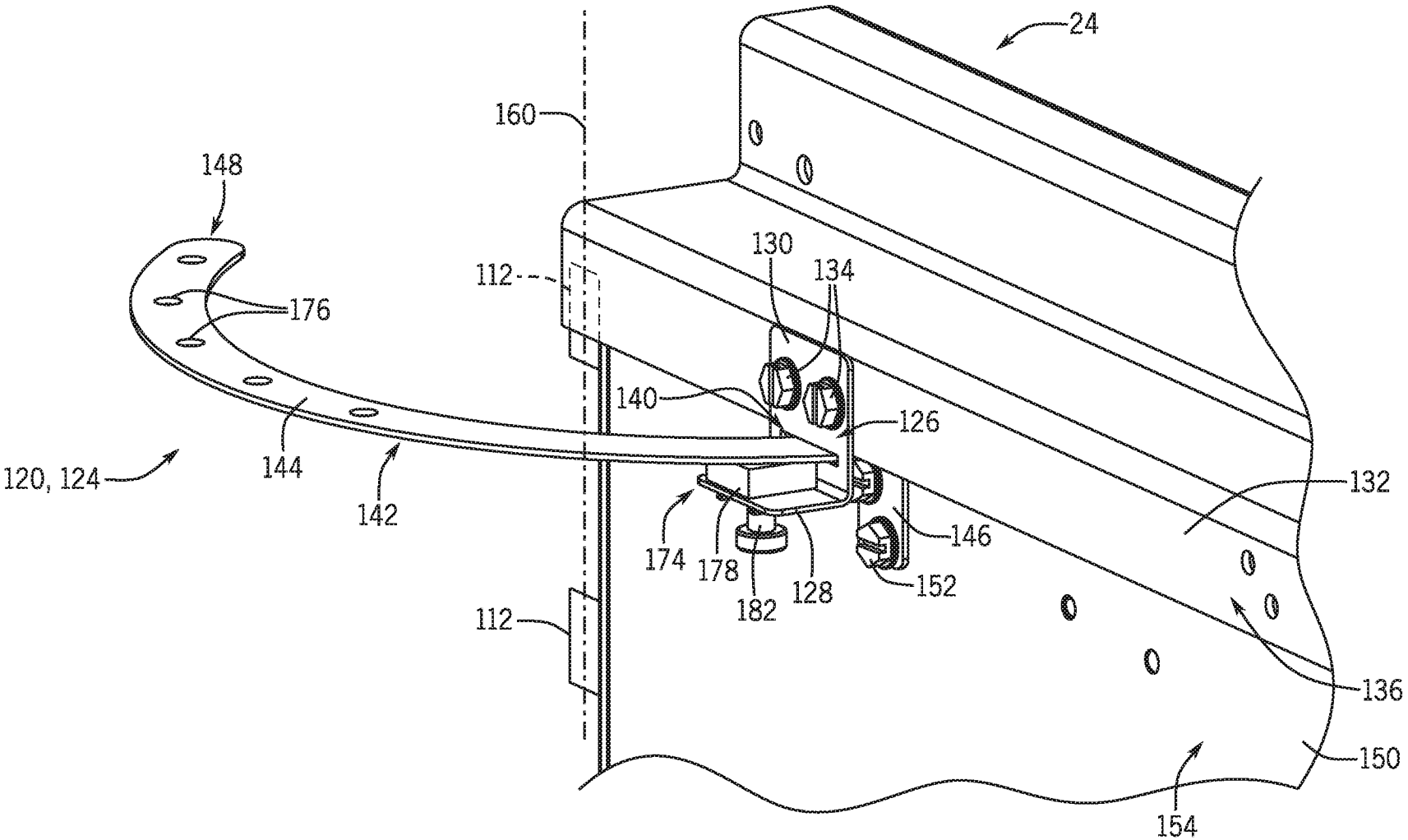
FIG. 7 is a perspective view of an embodiment of a portion of an HVAC unit having a panel restrictor, in accordance with an aspect of the present disclosure.
Figure 8:
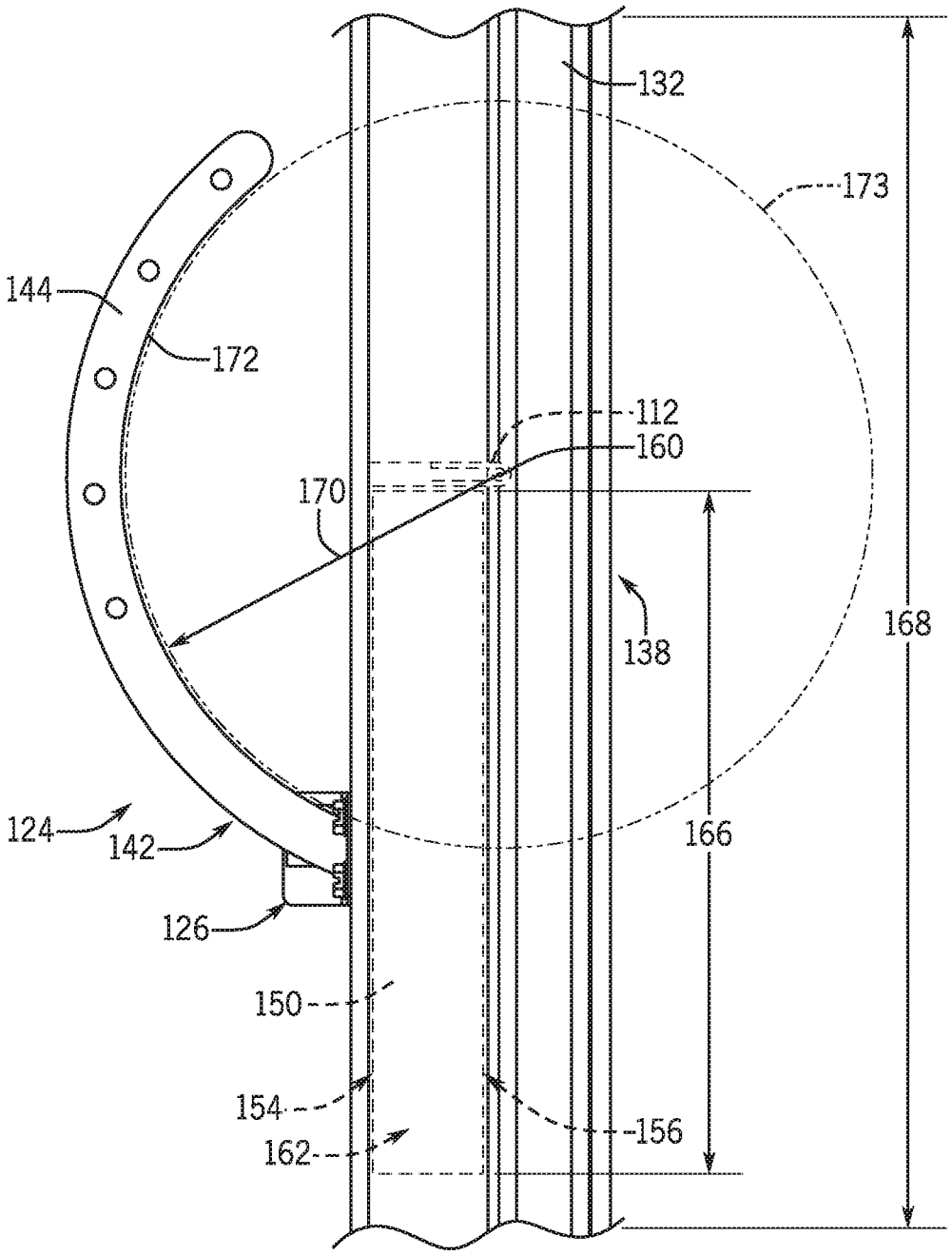
FIG. 8 is a top view of an embodiment of a portion of an HVAC unit having a panel restrictor, in accordance with an aspect of the present disclosure.

With the foregoing in mind, FIG. 6 is a perspective view of an embodiment of one of the panel restrictors 120, referred to herein as a first panel restrictor 124. FIG. 7 is a perspective view of an embodiment of a portion of the cabinet 24 having the first panel restrictor 124. FIGS. 6 and 7 will be discussed concurrently below. The first panel restrictor 124 includes a first bracket 126 having a first flange 128 and a second flange 130 that extends generally cross-wise to the first flange 128. The second flange 130 is configured to couple to a structural support 132 of the HVAC unit 12 using one or more fasteners 134, adhesives, or a metallurgical process, such as welding or brazing. The structural support 132 may include a portion of the frame 106 or any other suitable railing or bracing of the HVAC unit 12. Particularly, the second flange 130 may be coupled to an interior surface 136 of the structural support 132 that faces the interior volume 104 of the cabinet 24. That is, the interior surface 136 may be positioned opposite to an exterior surface 138, as shown in FIG. 8, of the structural support 132, which faces the ambient environment surrounding the HVAC unit 12.

In the illustrated embodiment, a slot 140 is formed within the second flange 130 and is configured to receive a second bracket 142 of the first panel restrictor 124. The second bracket 142 includes an arcuate segment 144 that extends generally cross-wise to a mounting flange 146 or mounting portion of the second bracket 142. As discussed below, in some embodiments, the arcuate segment 144 may include a generally constant radius of curvature that extends from the mounting flange 146 to a distal end 148 of the arcuate segment 144. The mounting flange 146 is configured to couple to one of the panel assemblies 102, referred to herein as a panel assembly 150 or a panel, using, for example, suitable fasteners 152. In particular, the mounting flange 146 may be configured to couple to an inner wall 154 of the panel assembly 150 that faces the interior volume 104 and is positioned opposite to an outer wall 156, as shown in FIG. 8, of the panel assembly 150, which faces the ambient environment surrounding the HVAC unit 12. In some embodiments, the first bracket 126, the second bracket 142, or both, may each be single-piece components formed from sheet metal or from another suitable material.

The panel assembly 150 may be pivotably coupled to the structural support 132 and/or to another portion of the frame 106 via the hinge assemblies 112. For example, in some embodiments, the panel assembly 150 may be pivotably coupled to the structural support 132 and to a lower structural support, such as the frame rails 26, via the hinge assemblies 112. For clarity, it should be understood that, the structural support 132 and the frame rails 26 may collectively form a portion of the frame 106. In any case, the hinge assemblies 112 enable the panel assembly 150 to pivot about an axis 160 of the hinge assemblies 112 relative to the frame 106. In some embodiments, the hinge assemblies 112 may be configured to support a portion of or substantially all of a weight of the panel assembly 150. As such, in some embodiments, the first panel restrictor 124 may support substantially none of the weight of the panel assembly 150. For clarity, as used herein, the panel assembly 150, the hinge assemblies 112, and the first panel restrictor 124 may collectively be referred to as a door assembly of the HVAC unit 12.

Figure 9:
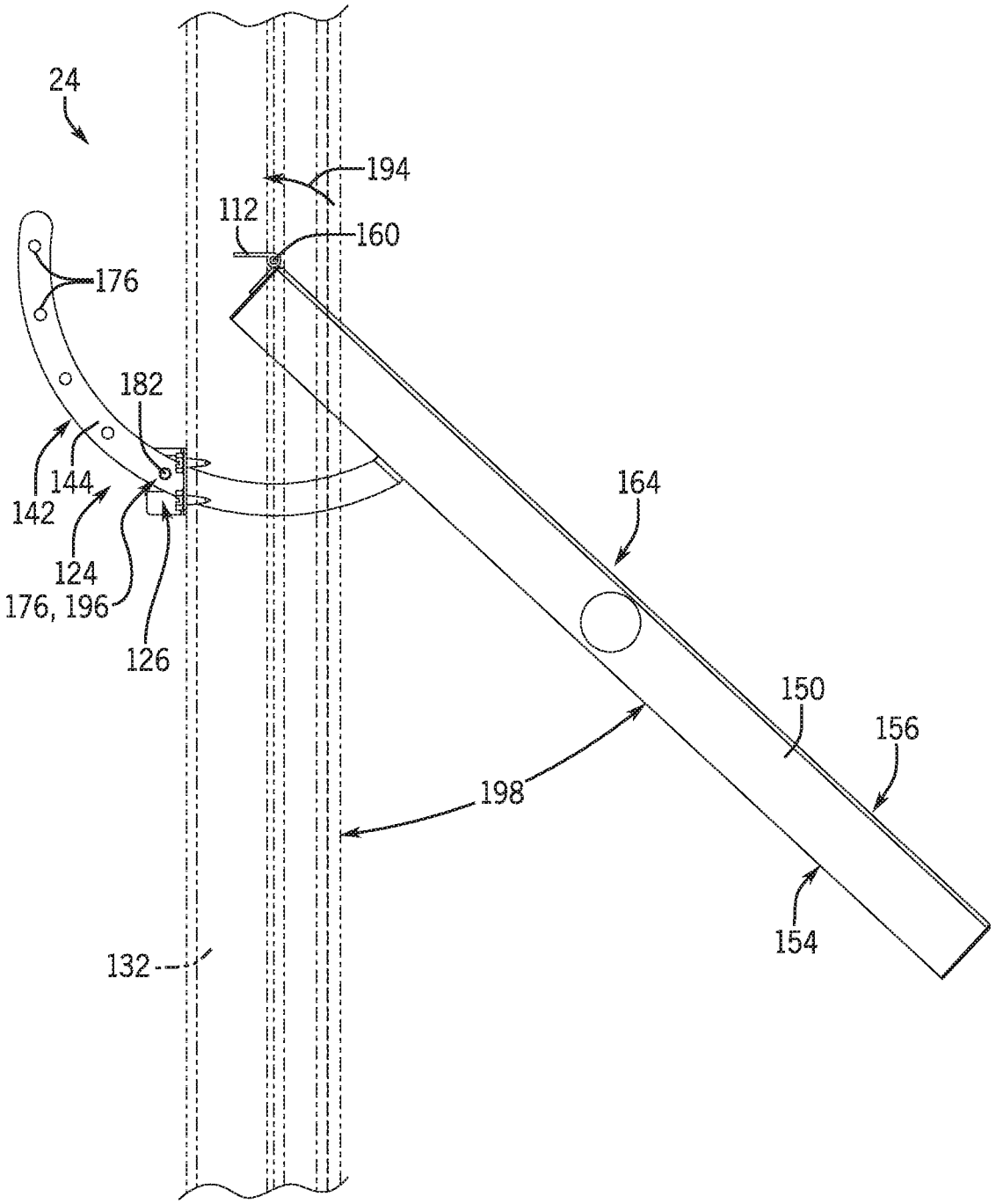
FIG. 9 is a top view of an embodiment of a portion of an HVAC unit having a panel restrictor, in accordance with an aspect of the present disclosure.

In the illustrated embodiment, the arcuate segment 144 is configured to translate through the slot 140 when the panel assembly 150 pivots about the axis 160. In this manner, the arcuate segment 144 may permit the panel assembly 150 to transition between a closed position 162, as shown in FIG. 8, and an open position 164, as shown in FIG. 9, substantially without interference between the arcuate segment 144 and the first bracket 126.

For example, to better illustrate and to facilitate the following discussion, FIG. 8 is a top view of an embodiment of a portion of the cabinet 24, illustrating the panel assembly 150 in the closed position 162. For clarity, in the closed position 162, a length 166 of the panel assembly 150 may extend substantially parallel to a length 168 of the structural support 132. In some embodiments, a radial dimension 170 between the axis 160 and an edge 172 of the arcuate segment 144 may be substantially constant along a length of the edge 172. As a result, the arcuate segment 144 may translate along a circumferential path 173 about the axis 160 when the panel assembly 150 is pivoted about the axis 160 from the closed position 162 to the open position 164, or vice versa. Therefore, the arcuate segment 144 may translate through the slot 140 of the second bracket 142 without interference with the second bracket 142 when the panel assembly 150 pivots about the axis 160. For clarity, the edge 172 may be indicative of a radially inward edge of the arcuate segment 144 that extends substantially between the mounting flange 146 and the distal end 148 of the arcuate segment 144.

The following discussion continues with reference to FIGS. 6 and 7. In some embodiments, the first bracket 126 includes an engager assembly 174 that is coupled to the first flange 128 of the first bracket 126. The engager assembly 174 is configured to selectively engage with one of a plurality of apertures 176 formed within the arcuate segment 144. In this manner, the engager assembly 174 may selectively couple the first bracket 126 to the arcuate segment 144 to secure the arcuate segment 144 within the slot 140 at a plurality of discrete positions or discrete orientations.

For example, in some embodiments, the engager assembly 174 includes a nut 178 that is coupled to the first flange 128. The nut 178 includes an aperture formed therein that is configured to align with an axis 180 of a corresponding aperture formed within the first flange 128. The apertures within the nut 178 and the first flange 128 are configured to receive a bolt 182 and to support the bolt 182. For example, in some embodiments, the bolt 182 may include external threads that are configured to engage with corresponding internal threads of the nut 178. As such, the nut 178 may support the bolt 182, while rotation of the bolt 182 relative to the nut 178 enables the bolt 182 to translate axially along the axis 180. As discussed below, in this manner, an operator or other service technician may rotate the bolt 182 to selectively engage or disengage the bolt 182 with one of the apertures 176 formed within the arcuate segment 144. As such, the operator may selectively couple or decouple the first bracket 126 and the second bracket 142 to disable or enable, respectively, movement between the first and second brackets 126, 142.

It should be appreciated that, in other embodiments, the engager assembly 174 may include any other suitable mechanism or device that enables an operator to removably couple the first bracket 126 to the second bracket 142. For example, in certain embodiments, the bolt 182 may be replaced with a pin, and a spring may be used to bias the pin in a biasing direction 188 toward the arcuate segment 144. As such, the spring may force the pin through one of the apertures 176 when the pin is aligned with the aperture, thereby removably coupling the first bracket 126 to the second bracket 142. In such embodiments, to decouple the first bracket 126 from the second bracket 142, an operator may pull the pin in a releasing direction 190, opposite to the biasing direction 188, to remove the pin from the aperture 176 and enable movement of the arcuate segment 144 relative to the first bracket 126.

FIG. 9 is a top view of an embodiment of a portion of the cabinet 24, illustrating the panel assembly 150 in the open position 164. To transition the panel assembly 150 from the closed position 162 to the open position 164, an operator may rotate the panel assembly 150 about the axis 160 in a counter-clockwise direction 194. Specifically, the operator may rotate the panel assembly 150 until one of the apertures 176, such as a first aperture 196, of the arcuate segment 144 is aligned with the bolt 182. Upon alignment of the first aperture 196 with the bolt 182, the operator may rotate the bolt 182 in accordance with the techniques discussed above to engage the bolt 182 with the first aperture 196 of the arcuate segment 144. As such, the operator may removable couple the first bracket 126 to the second bracket 142, such that the first panel restrictor 124 may retain the panel assembly 150 in the open position 164. That is, the first panel restrictor 124 may block pivotal motion of the panel assembly 150 about the axis 160 while the first bracket 126 is coupled to the second bracket 142 via the engager assembly 174, and the panel assembly 150 may be retained in a desired position.

Figure 10:
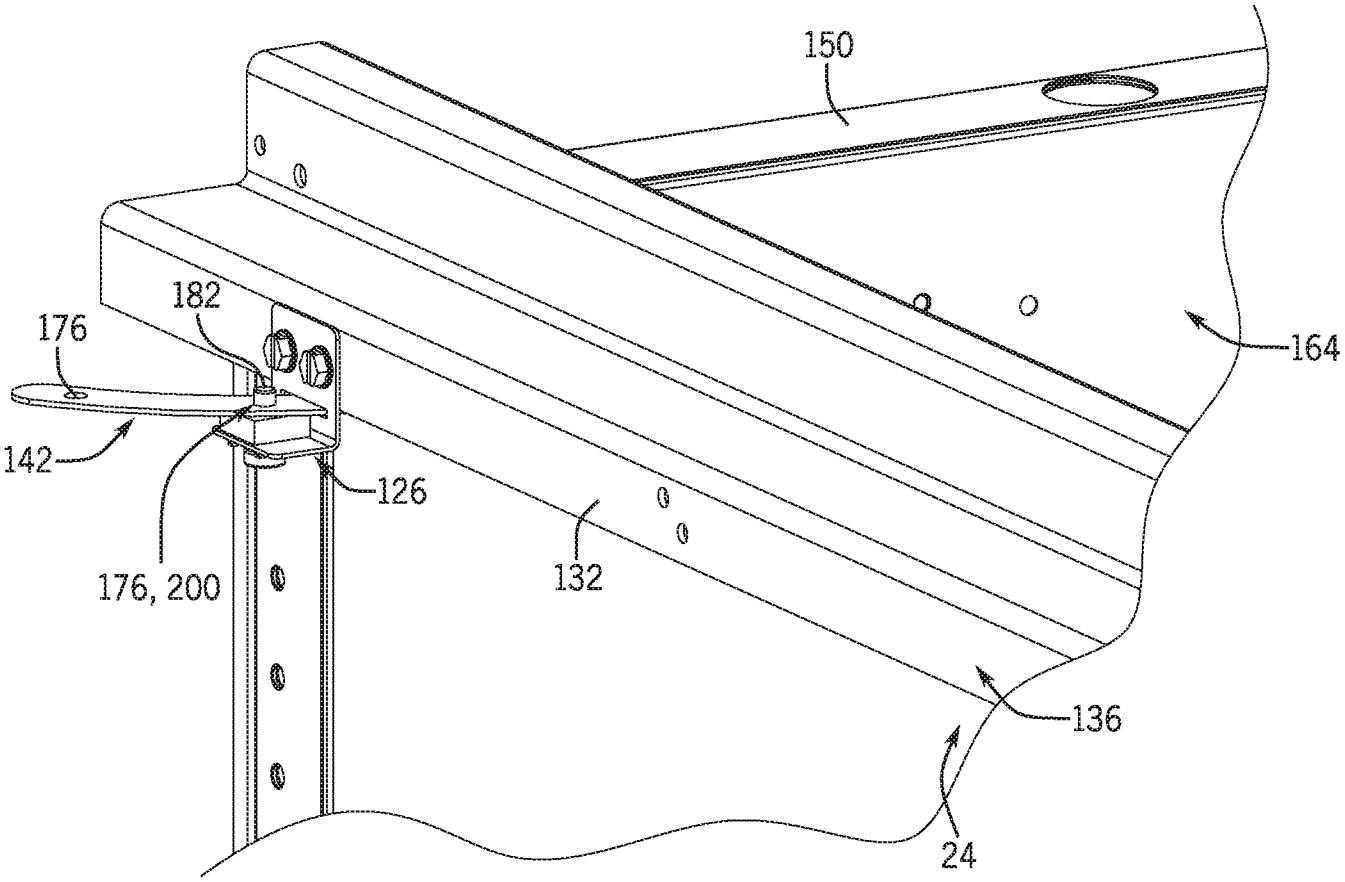
FIG. 10 is a perspective view of an embodiment of a portion of an HVAC unit having a panel restrictor, in accordance with an aspect of the present disclosure.

It should be understood that the operator may engage the bolt 182 with any of the apertures 176 to retain the panel assembly 150 in various other open positions 164. That is, by selecting the particular aperture 176 with which the bolt 182 is engaged, the operator may adjust an angular increment 198 by which the panel assembly 150 is offset from the structural support 132 when in the open position 164. As an example, FIG. 10 is a perspective view of an embodiment of a portion of the cabinet 24, illustrating the bolt 182 engaged with a second aperture 200 of the arcuate segment 144 that is located near the distal end 148 of the arcuate segment 144. It should be appreciated that, engaging the bolt 182 with one of the apertures 176 positioned near the distal end 148 increases the angular increment 198, while engaging the bolt 182 with one of the apertures 176 positioned near the mounting flange 146 decreases the angular increment 198. Indeed, it should be appreciated that engaging the bolt 182 with any of the apertures 176 may enable the first panel restrictor 124 to position and retain the panel assembly 150 in a plurality of discrete orientations with respect to the frame 106.

Figure 11:
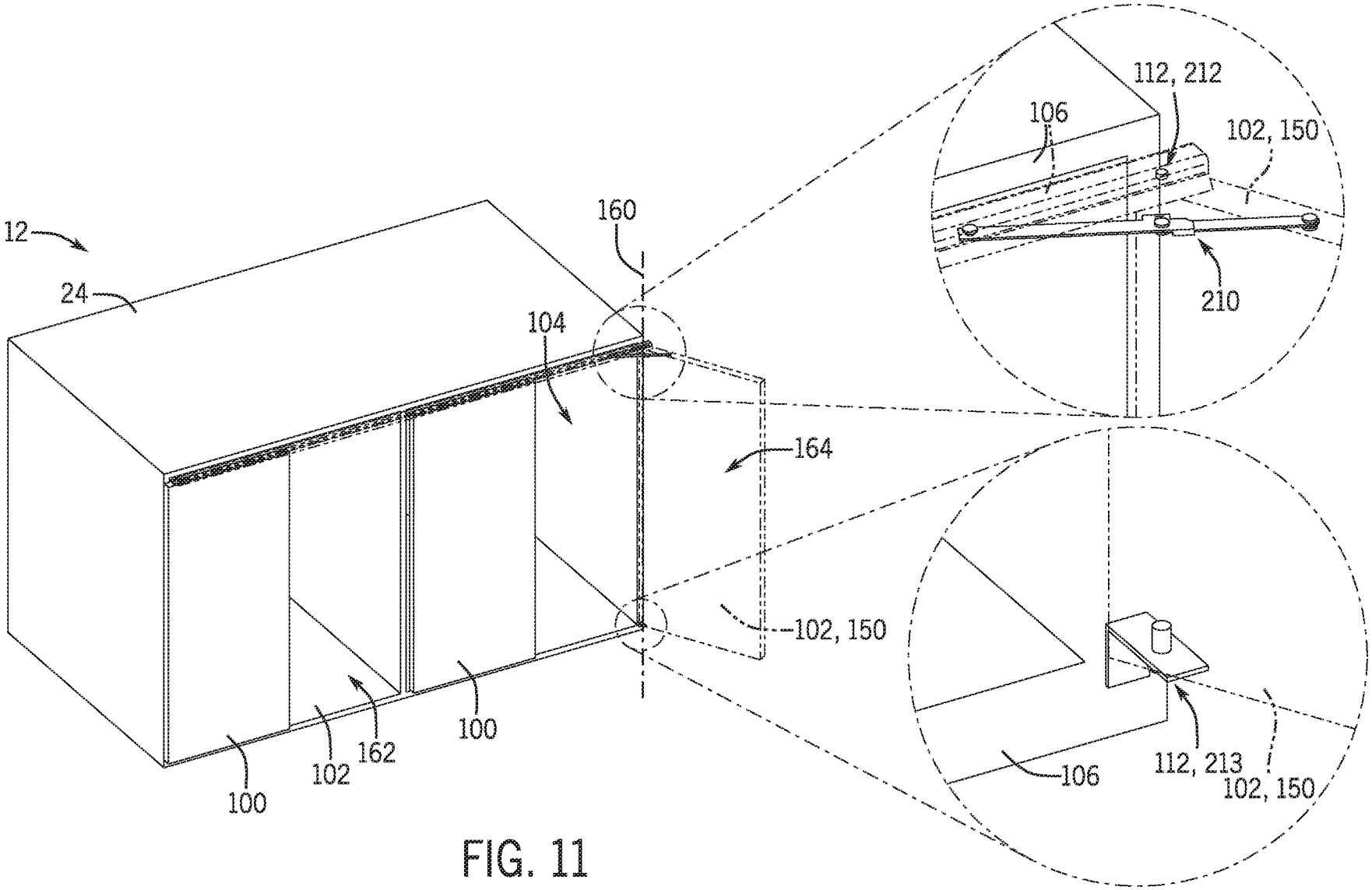
FIG. 11 is a perspective view of an embodiment of an HVAC unit having a panel restrictor, in accordance with an aspect of the present disclosure.

FIG. 11 is a perspective view of an embodiment of the HVAC unit 12, illustrating another embodiment of one of the panel restrictors 120, referred to herein as a second panel restrictor 210. Similar to the first panel restrictor 124 discussed above, the second panel restrictor 210 may be configured to selectively secure and retain the panel assembly 150 in a plurality of discrete positions. As shown in the illustrated embodiment, the hinge assemblies 112 may include a first hinge 212 and a second hinge 213 that are configured to pivotably couple the panel assembly 150 to the frame 106. As such, the first and second hinges 212, 213 enable the panel assembly 150 to pivot about the axis 160.

Figure 12:
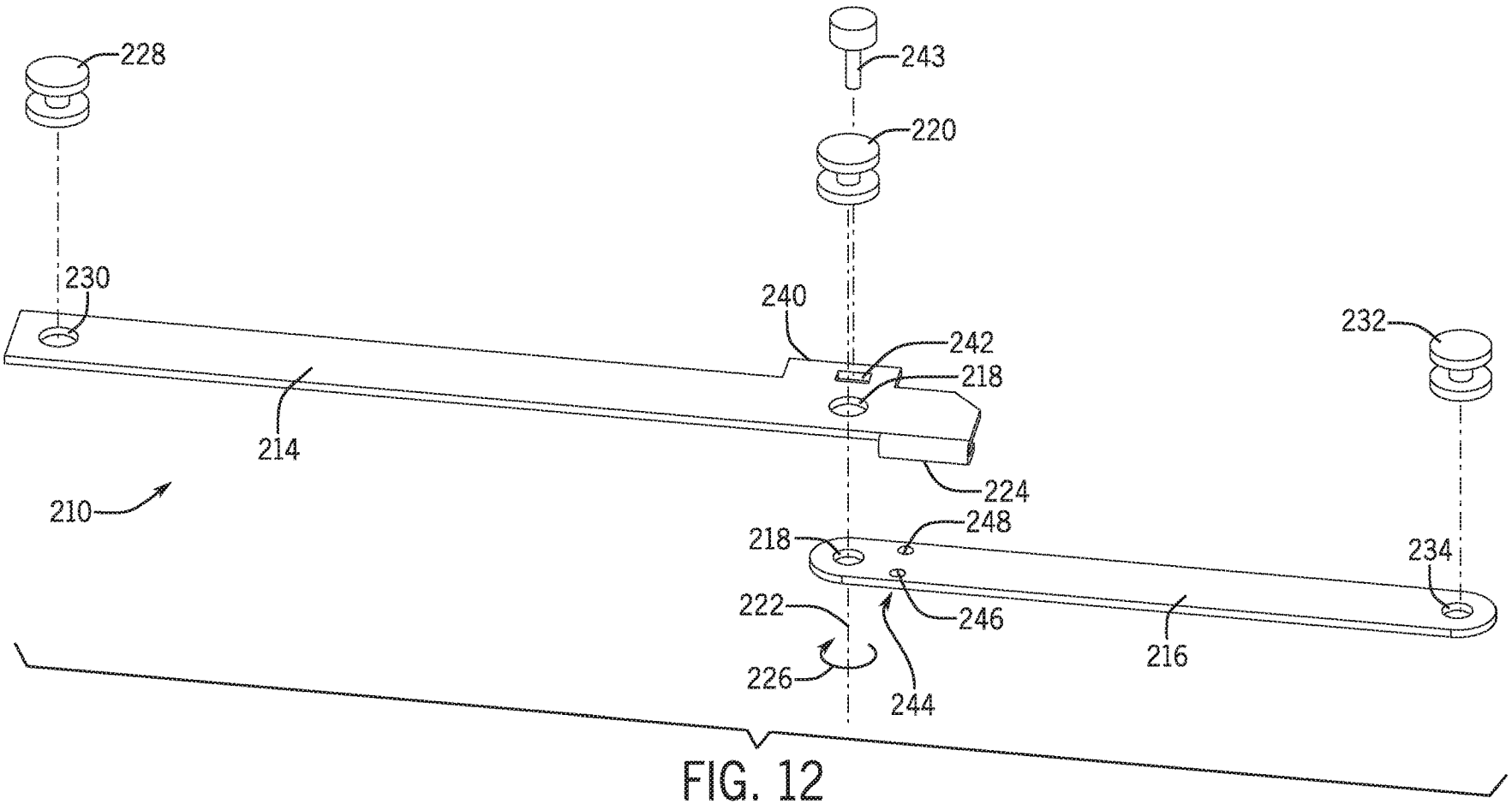
FIG. 12 is an exploded perspective view of an embodiment of a panel restrictor for an HVAC unit, in accordance with an aspect of the present disclosure.
Figure 13:
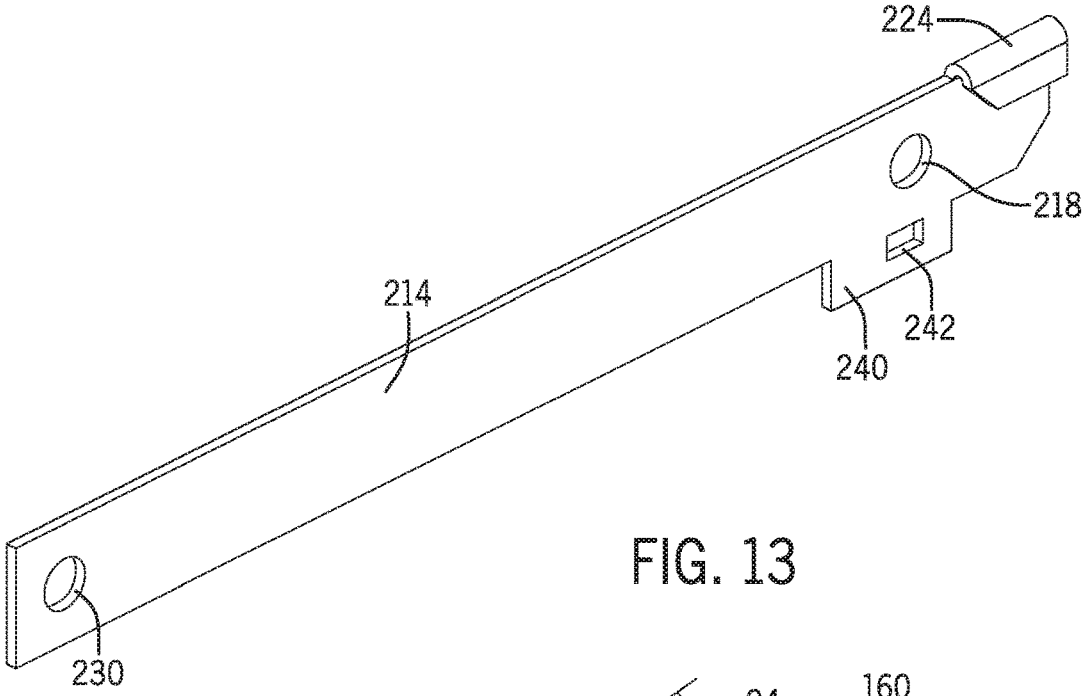
FIG. 13 is a perspective view of an embodiment of a link for a panel restrictor, in accordance with an aspect of the present disclosure.

To better illustrate the second panel restrictor 210, FIG. 12 is an exploded perspective view of an embodiment of the second panel restrictor 210. The second panel restrictor 210 includes a first link 214 and a second link 216 having respective pivoting apertures 218 formed therein. A first pin 220 is configured extend through the pivoting apertures 218 to pivotably couple the first link 214 to the second link 216 and enable movement of the first link 214 relative to the second link 216 about a pivoting axis 222. As discussed in detail below, the first link 214 includes a hook 224, as also shown in FIG. 13, which is configured to engage with the second link 216 to limit pivotal motion of the second link 216, relative to the first link 214, about the pivoting axis 222. In particular, the hook 224 is configured to limit pivotal motion of the second link 216, relative to the first link 214, in a clockwise direction 226 about the pivoting axis 222. In some embodiments, the first link 214, the second link 216, or both, may each be a single-piece component that is formed from sheet metal or another suitable material.

Figure 14:
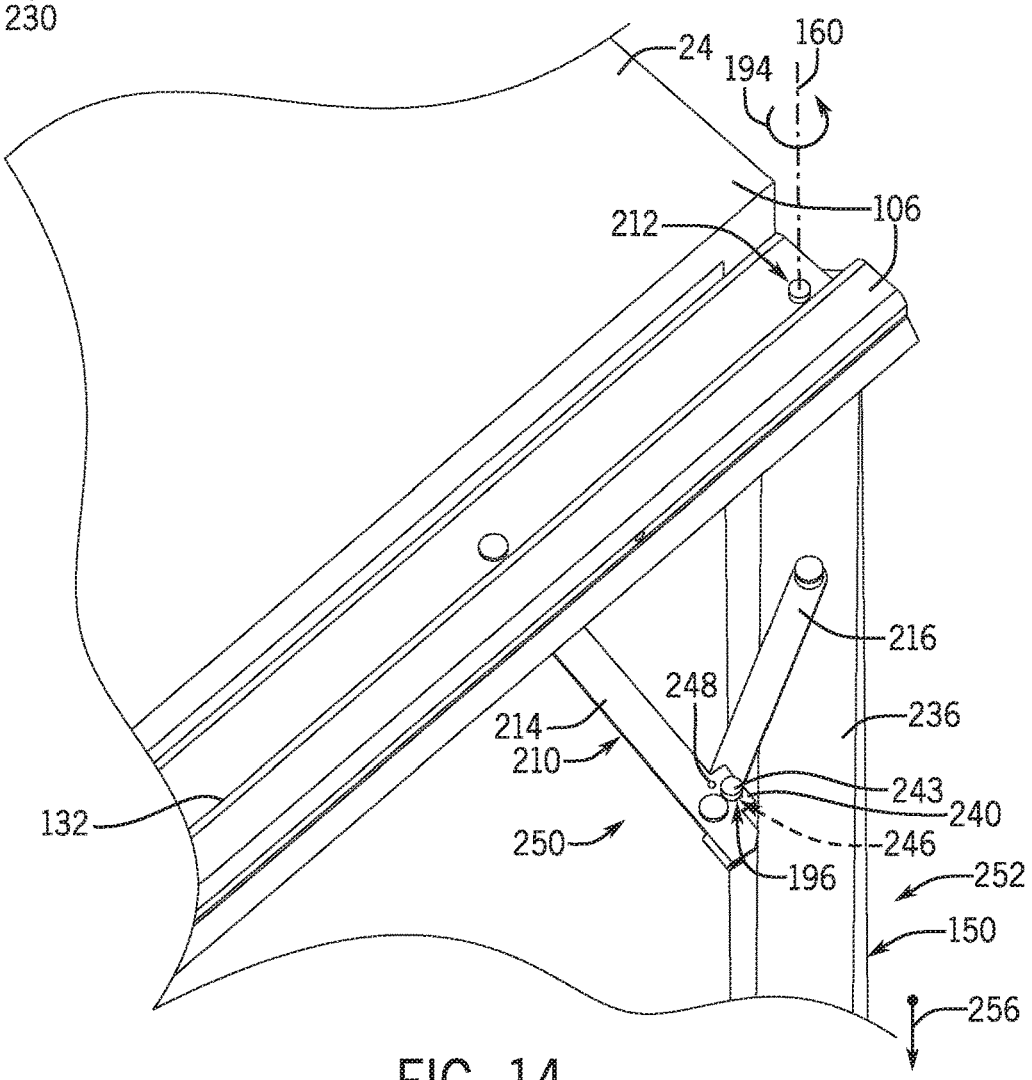
FIG. 14 is a perspective view of an embodiment of a portion of an HVAC unit having a panel restrictor, in accordance with an aspect of the present disclosure.

The second panel restrictor 210 includes a second pin 228 that is configured to extend through a corresponding aperture 230 in the first link 214 to pivotably couple the first link 214 to the structural support 132 or to another suitable portion of the cabinet 24. A third pin 232 is configured to extend through a corresponding aperture 234 in the second link 216 to pivotably couple the second link 216 to the panel assembly 150. In particular, the third pin 232 may pivotably couple the second link 216 to an end face 236, as shown in FIG. 14, of the panel assembly 150. The first link 214 includes an ear 240 or ledge having a slot 242 or aperture formed therein. The slot 242 is configured to receive and support an engagement pin 243 that, as discussed below, is configured to engage with one of a plurality of apertures 244, such as a first aperture 246 and a second aperture 248, formed within the second link 216. In this manner, the engagement pin 243 may be configured to removably couple the first link 214 to the second link 216 at a plurality of discrete positions. It should be understood that, in other embodiments, the plurality of apertures 244 may include any suitable quantity of individual apertures 244, such as 1, 2, 3, 4, or more than four apertures 244. Moreover, it should be appreciated that the engagement pin 243 may include a threaded rod or bolt, a spring and pin assembly, or another suitable mechanism or device configured to removably couple the first link 214 to the second link 216 at one or more discrete positions relative to one another.

FIG. 14 is a perspective view of an embodiment of a portion of the cabinet 24, illustrating the second panel restrictor 210 in a first configuration 250, in which the second panel restrictor 210 is configured to retain the panel assembly 150 in a first partially open position 252. For example, to transition the panel assembly 150 from the closed position 162 to the first partially open position 252, an operator may pivot the panel assembly 150 about the axis 160 in the counter-clockwise direction 194 until the slot 242 of the first link 214 is aligned with the first aperture 246 of the second link 216. Upon alignment of the slot 242 with the first aperture 246, the operator may insert the engagement pin 243 through the slot 242 and the first aperture 246 in a downward direction 256, with respect to gravity, such that a head of the engagement pin 243 may rest on the ear 240 and a shaft of the engagement pin 243 extends through the slot 242 and the first aperture 246. In this manner, the engagement pin 243 may removably couple the first link 214 to the second link 216 to block pivotal motion of the first link 214 relative to the second link 216 and to retain a particular position of the first link 214 relative to the second link 216. As such, while the engagement pin 243 is engaged with the slot 242 and the first aperture 246, the second panel restrictor 210 may retain the panel assembly 150 in the first partially open position 252 and block pivotal motion of the panel assembly 150 about the axis 160. To re-enable pivotal motion of the panel assembly 150 about the axis 160, the operator may disengage the engagement pin 243 from the first aperture 246 by, for example, removing the engagement pin 243 from the slot 242 and the first aperture 246.

Figure 15:
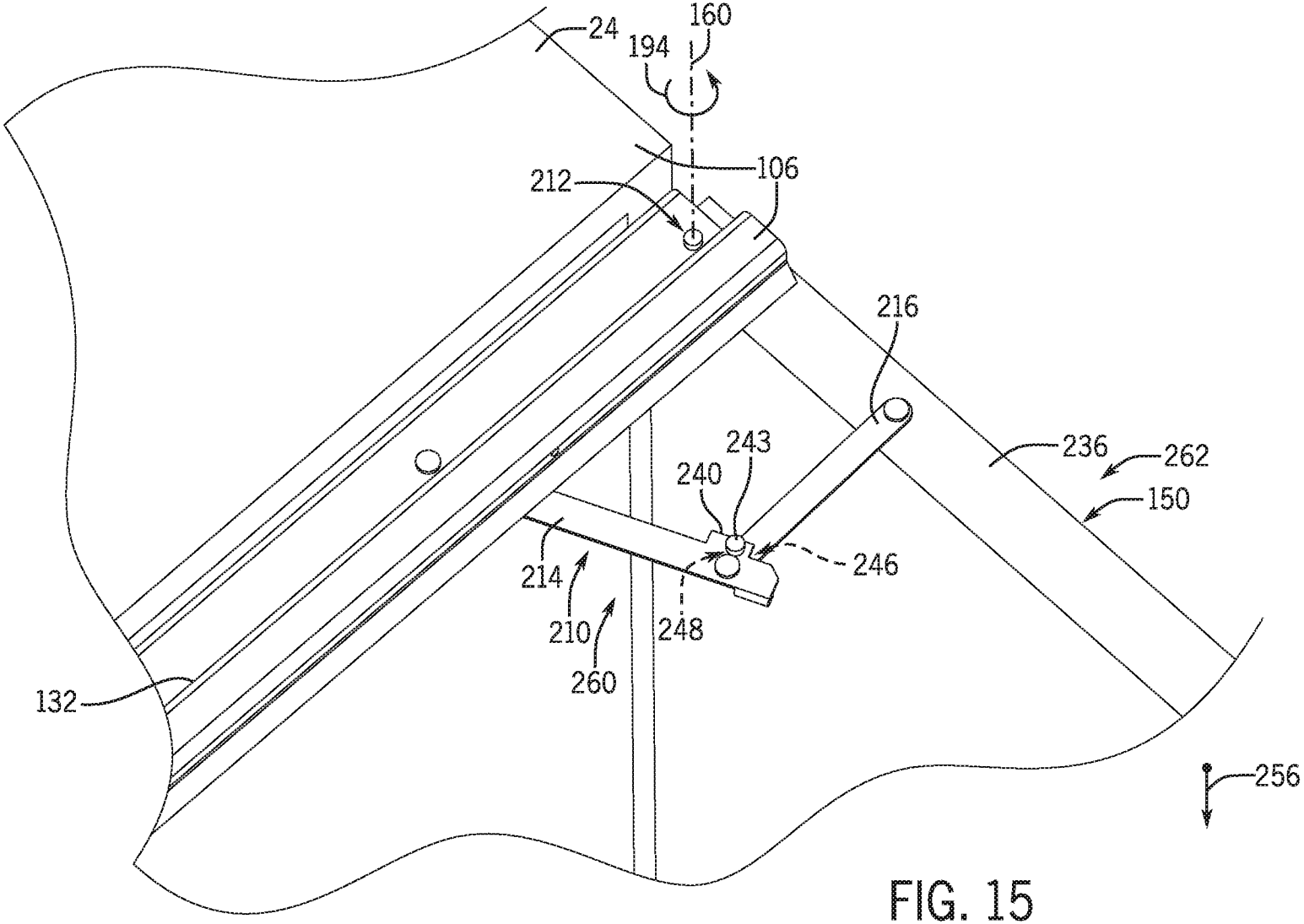
FIG. 15 is a perspective view of an embodiment of a portion of an HVAC unit having a panel restrictor, in accordance with an aspect of the present disclosure.

FIG. 15 is a perspective view of an embodiment of a portion of the cabinet 24, illustrating the second panel restrictor 210 in a second configuration 260, in which the second panel restrictor 210 is configured to retain the panel assembly 150 in a second partially open position 262. To transition the panel assembly 150 from, for example, the first partially open position 252 to the second partially open position 262, an operator may pivot the panel assembly 150 about the axis 160 in the counter-clockwise direction 194 until the slot 242 of the first link 214 is aligned with the second aperture 248 of the second link 216. Upon alignment of the slot 242 with the second aperture 248, the operator may insert the engagement pin 243 through the slot 242 and the second aperture 248 in the downward direction 256, such that the head of the engagement pin 243 may rest on the ear 240 and the shaft of the engagement pin 243 extends through the slot 242 and the second aperture 248. In this manner, the engagement pin 243 may removably couple the first link 214 to the second link 216 to block pivotal motion of the first link 214 relative to the second link 216 and to retain a particular position of the first link 214 relative to the second link 216. As such, while the engagement pin 243 is engaged with the slot 242 and the second aperture 248, the second panel restrictor 210 may retain the panel assembly 150 in the second partially open position 262 and block pivotal motion of the panel assembly 150 about the axis 160. To re-enable pivotal motion of the panel assembly 150 about the axis 160, the operator may disengage the engagement pin 243 from the second aperture 248 by, for example, removing the engagement pin 243 from the slot 242 and the second aperture 248.

Figure 16:
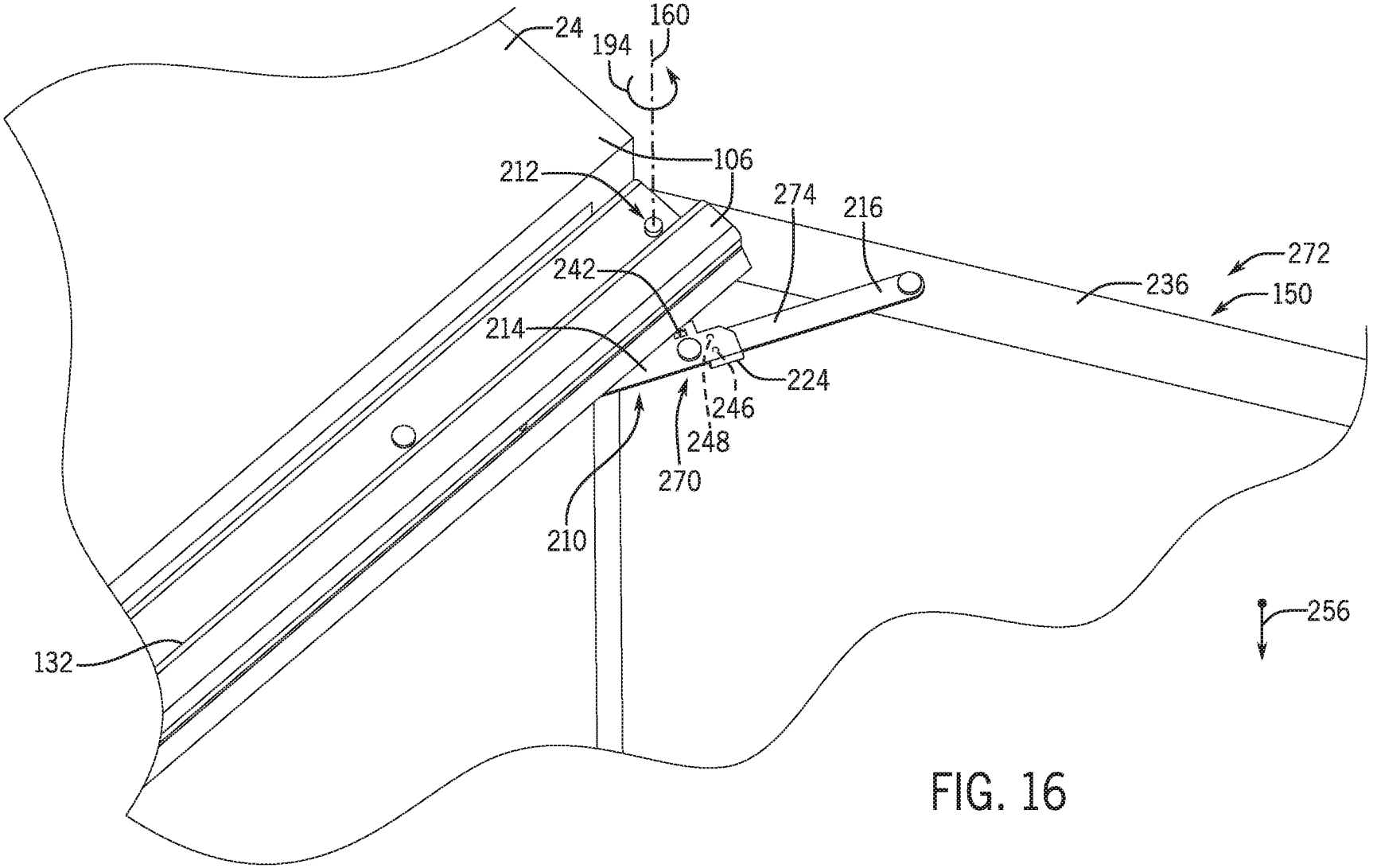
FIG. 16 is a perspective view of an embodiment of a portion of an HVAC unit having a panel restrictor, in accordance with an aspect of the present disclosure.
Figure 17:
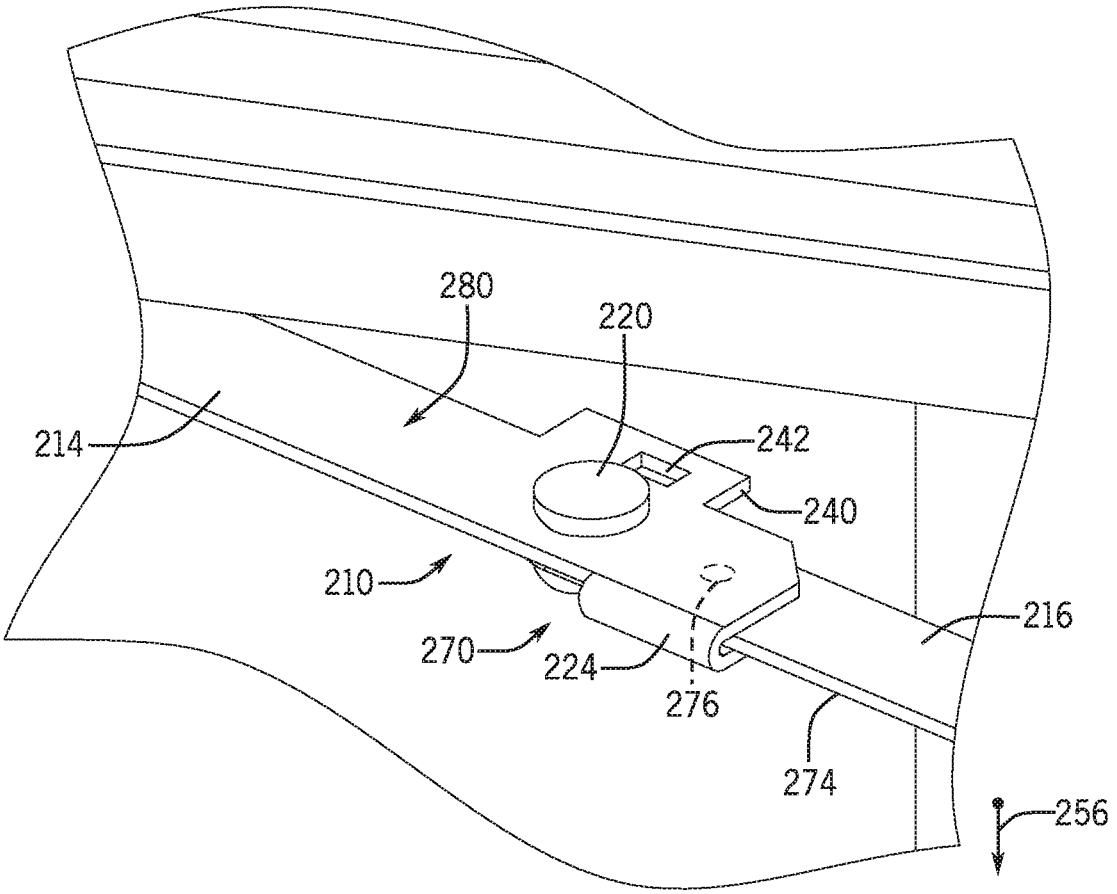
FIG. 17 is a close-up perspective view of an embodiment of a panel restrictor for an HVAC unit, in accordance with an aspect of the present disclosure.

FIG. 16 is a perspective view of an embodiment of a portion of the cabinet 24, illustrating the second panel restrictor 210 in a third configuration 270, in which the second panel restrictor 210 is configured to retain the panel assembly 150 in a fully open position 272. FIG. 17 is a close-up perspective view of an embodiment of the second panel restrictor 210 in the third configuration 270. FIGS. 16 and 17 will be discussed concurrently below. To transition the panel assembly 150 from, for example, the second partially open position 262 toward the fully open position 272, an operator may pivot the panel assembly 150 about the axis 160 in the counter-clockwise direction 194 until a body 274 of the second link 216 extends into and engages with the hook 224 of the first link 214. Indeed, as noted above, the hook 224 may block pivotal motion of the second link 216 relative to the first link 214 in the counter-clockwise direction 194 beyond a particular angular increment.

As shown in the illustrated embodiment of FIG. 17, an aperture 276 may be formed within the first link 214 and configured to align with one of the first or second apertures 246, 248 of the second link 216 when the second link 216 engages with the hook 224. Upon alignment of the aperture 276 with the first aperture 246 or the second aperture 248, the operator may insert the engagement pin 243 through the aperture 276 and the first or second apertures 246, 248 in the downward direction 256, such that the head of the engagement pin 243 may rest on a surface 280 of the first link 214 and the shaft of the engagement pin 243 extends through the aperture 276 and the first or second apertures 246, 248. In this manner, the engagement pin 243 may block pivotal motion of the first link 214 relative to the second link 216 to retain a position of the first link 214 relative to the second link 216. As such, the second panel restrictor 210 may retain the panel assembly 150 in the fully open position 272. To re-enable pivotal movement of the panel assembly 150 about the axis 160, the operator may disengage the engagement pin 243 from the aperture 276 and the first or second apertures 246, 248.

Figure 18:
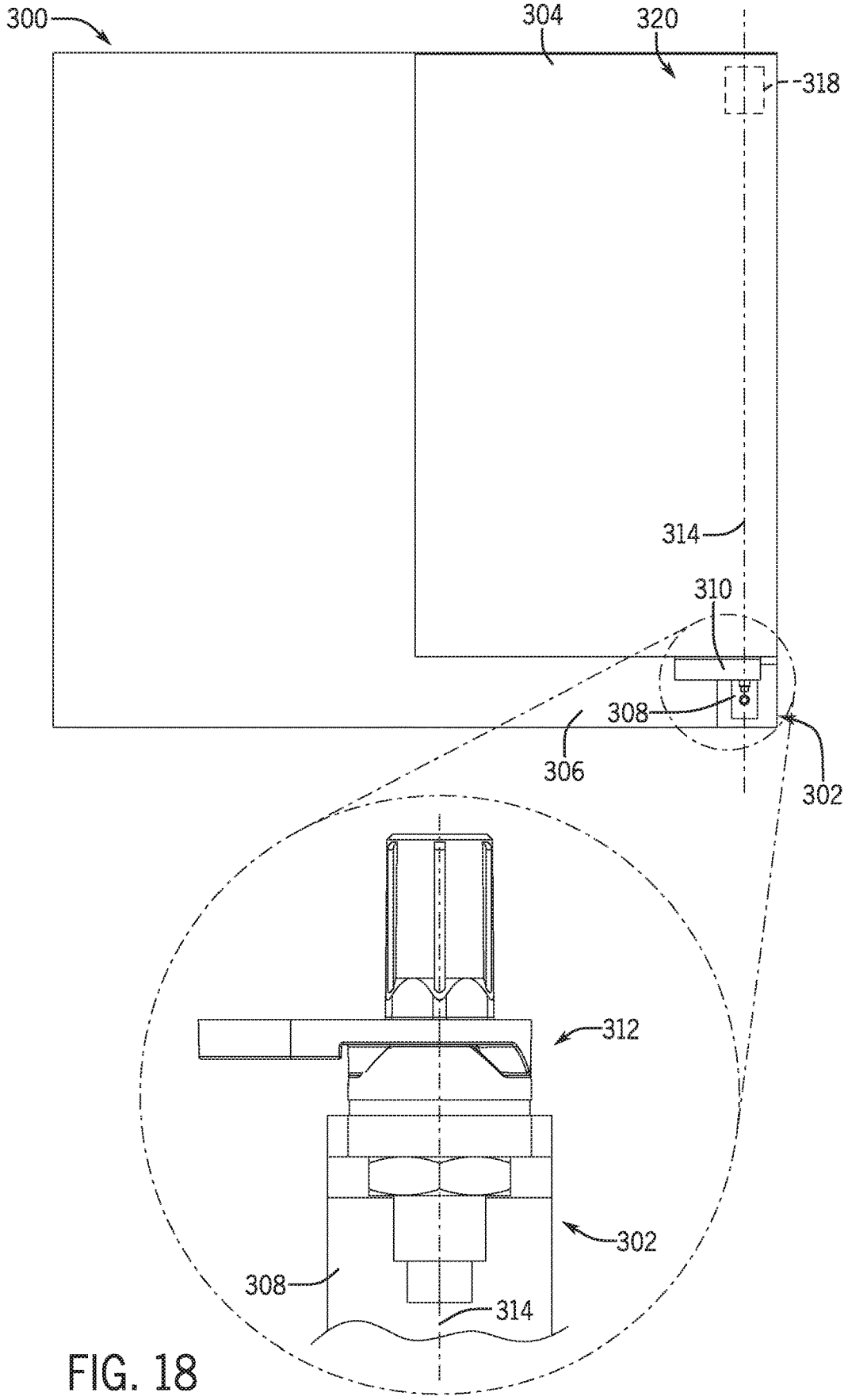
FIG. 18 is a perspective view of an embodiment of an electrical box having a panel restrictor, in accordance with an aspect of the present disclosure.

FIG. 18 is a side view of an embodiment of an electrical box 300, which may be included in embodiments of the HVAC unit 12 or embodiments of any of the aforementioned HVAC systems. The electrical box 300 is equipped with another embodiment of one of the panel restrictors 120, referred to herein as a third panel restrictor 302. Although the third panel restrictor 302 is described herein for use on the electrical box 300, it should be appreciated that the third panel restrictor 302 may also be implemented on the panel assemblies 102 of the HVAC unit 12.

As discussed in detail herein, the third panel restrictor 302 may be configured to hingedly couple a door 304, also referred to herein as a panel or panel assembly, to a frame 306 of the electrical box 300. For example, in the illustrated embodiment, the third panel restrictor 302 includes a frame bracket 308 that is coupled to the frame 306 and a support bracket 310 that is coupled to the door 304. In particular, the support bracket 310 is coupled to a base, bottom portion, or underside of the door 304 and is above, relative to the direction of gravity, the frame bracket 308 coupled to the frame 306. Further, the frame bracket 308 is pivotably coupled to the support bracket 310 via a pivoting assembly 312. Accordingly, the pivoting assembly 312 supports the door 304 and enables pivotal motion of the door 304, relative to the frame 306, about an axis 314 of the pivoting assembly 312.

In some embodiments, the electrical box 300 may include a hinge assembly 318 that is configured to cooperate with the third panel restrictor 302 to pivotably couple the door 304 to the frame 306. As such, the third panel restrictor 302 and the hinge assembly 318 may enable the door 304 to be selectively transitioned between a closed position 320 and an open position via rotation of the door 304 about the axis 314.

In some embodiments, the third panel restrictor 302 may be configured to support substantially all of a weight of the door 304 while enabling pivotal motion of the door 304 about the axis 314. In other embodiments, the third panel restrictor 302 and the hinge assembly 318 may cooperatively support a weight of the door 304. Moreover, in certain embodiments, a plurality of third panel restrictors 302 may be spaced along the axis 314 and used to pivotably couple to door 304 to the frame 306 and to collectively support a weight of the door 304. In such embodiments, the hinge assembly 318 may be omitted from the electrical box 300.

Figure 19:
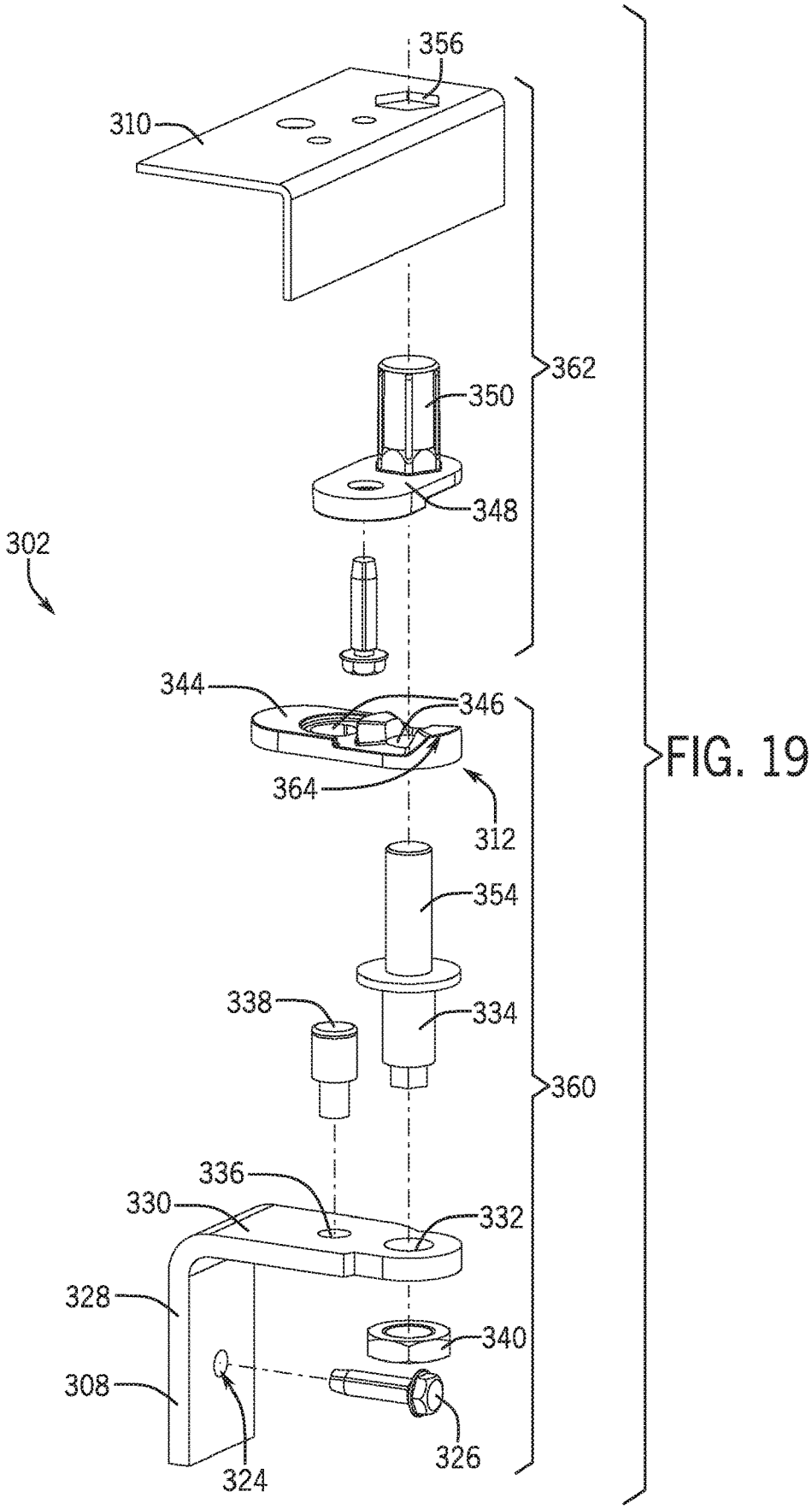
FIG. 19 is an exploded perspective view of an embodiment of a panel restrictor for an electrical box, in accordance with an aspect of the present disclosure.

To better illustrate the third panel restrictor 302 and its respective components, FIG. 19 is an exploded perspective view of an embodiment of the third panel restrictor 302. The frame bracket 308 includes one or more apertures 324 that enable suitable fasteners 326 to couple a first flange 328 of the frame bracket 308 to the frame 306. As shown in the illustrated embodiment, the frame bracket 308 includes a second flange 330 that extends generally cross-wise from the first flange 328. The second flange 330 includes a first aperture 332 configured to receive a guide pin 334 and a second aperture 336 configured to receive a retention pin 338. In some embodiments, one or more fastening nuts 340 may be used to secure the guide pin 334 and/or the retention pin 338 to the frame bracket 308. In other embodiments, the guide pin 334 and the retention pin 338 may be coupled to the frame bracket 308 via an interference fit with the corresponding apertures 332, 336 or via another suitable technique.

Figure 24:
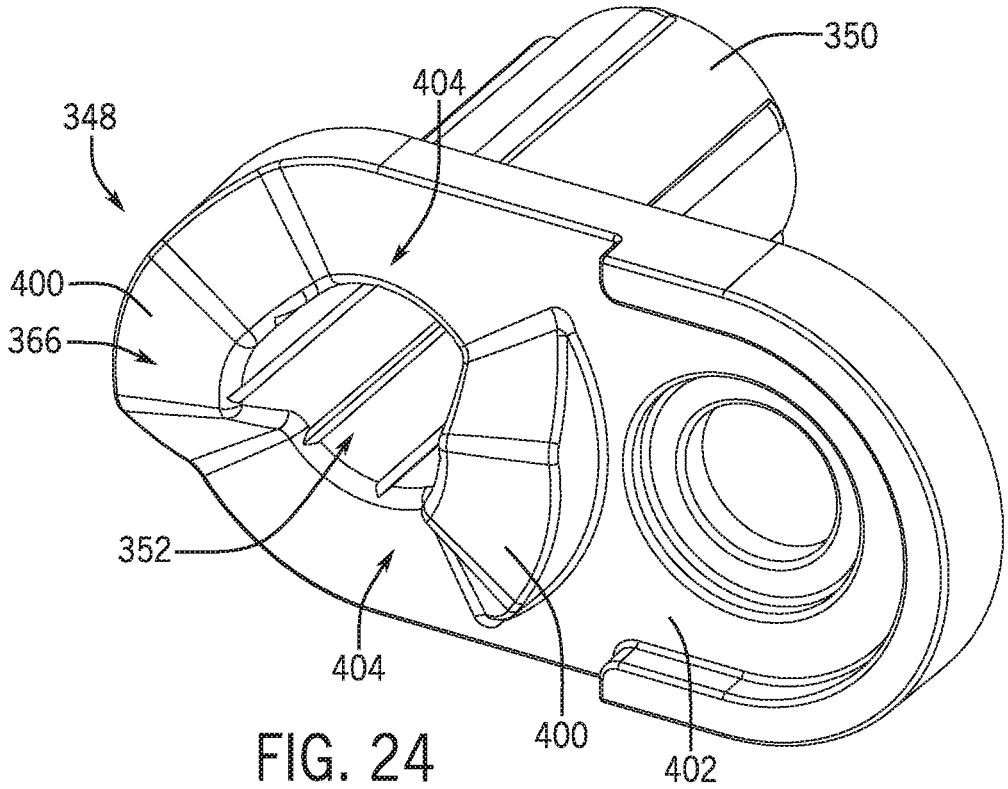
FIG. 24 is a perspective view of an embodiment of a cam for a panel restrictor, in accordance with an aspect of the present disclosure.

The pivoting assembly 312 includes a lower cam 344 having respective apertures 346 that are configured to engage with the guide pin 334 and the retention pin 338. As such, the guide pin 334 and the retention pin 338 may couple the lower cam 344 to the frame bracket 308. In particular, the guide pin 334 and the retention pin 338 may cooperate to block rotational motion of the lower cam 344 relative to the frame bracket 308. The pivoting assembly 312 also includes an upper cam 348 having a protrusion 350 with a cylindrical cavity 352, as shown in FIG. 24, formed therein. The cylindrical cavity 352 is configured to receive a shaft 354 of the guide pin 334. Accordingly, engagement between the shaft 354 and the cylindrical cavity 352 may pivotably couple the lower cam 344 to the upper cam 348. The protrusion 350 of the upper cam 348 is configured extend through a corresponding aperture 356 formed within the support bracket 310. As such, suitable fasteners may be used to couple the upper cam 348 to the support bracket 310. The frame bracket 308, the guide pin 334, the retention pin 338, and the lower cam 344 will collectively be referred to herein as a lower restrictor assembly 360. Moreover, the support bracket 310 and the upper cam 348 will collectively be referred to herein as an upper restrictor assembly 362.

The lower cam 344 includes a first lobed profile 364 that is configured to engage with a second lobed profile 366, as shown in FIG. 24, of the upper cam 348. As discussed in detail below, the engagement between the first and second lobed profiles 364, 366 enables the pivoting assembly 312 to retain the upper restrictor assembly 362 at a plurality of discrete rotational positions relative to the lower restrictor assembly 360.

Figure 20:
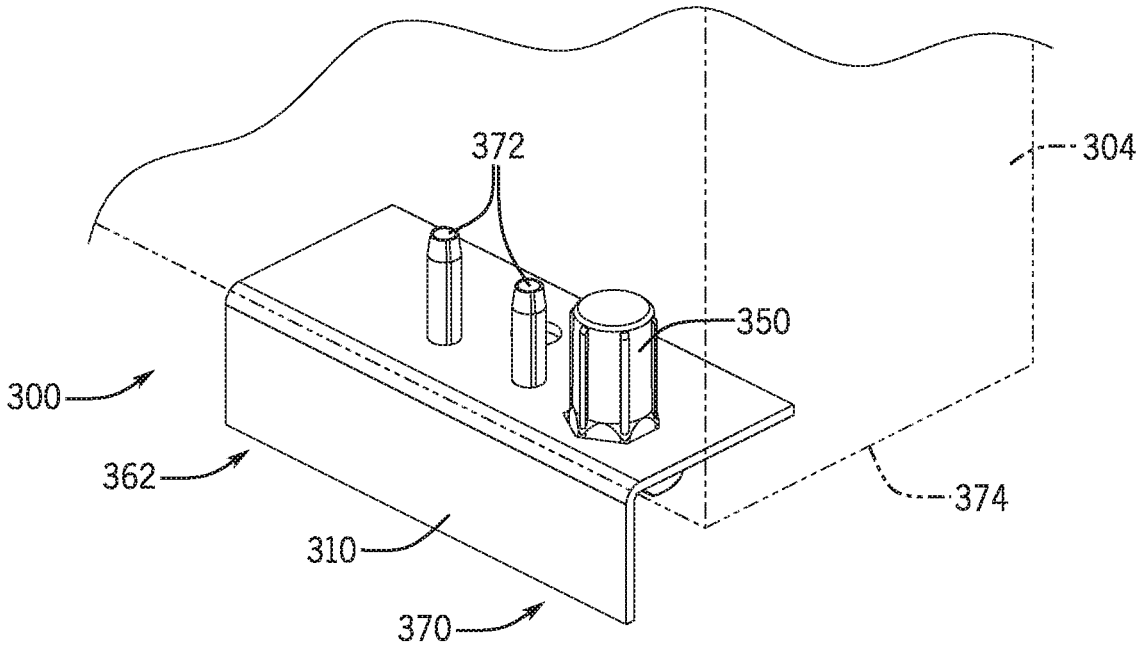
FIG. 20 is a perspective view of an embodiment of a portion of an electrical box having a bracket assembly of a panel restrictor, in accordance with an aspect of the present disclosure.
Figure 21:
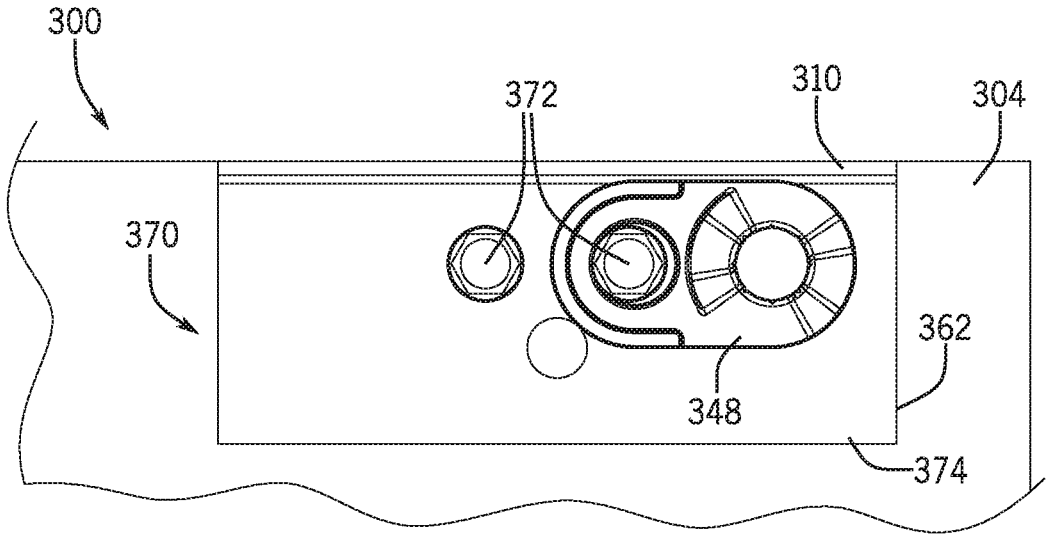
FIG. 21 is a bottom view of an embodiment of a portion of an electrical box having a bracket assembly of a panel restrictor, in accordance with an aspect of the present disclosure.

FIG. 20 is a perspective view of an embodiment of a portion of the electrical box 300, illustrating the upper restrictor assembly 362 in an installed configuration 370 on the door 304. FIG. 21 is a bottom view of an embodiment of the door 304, illustrating the upper restrictor assembly 362 in the installed configuration 370. FIGS. 20 and 21 will be discussed concurrently below. As shown in the illustrated embodiments of FIGS. 20 and 21, suitable fasteners 372 may be used to couple the support bracket 310 to a flange 374 or to another suitable portion of the door 304. It should be appreciated that the protrusion 350 of the upper cam 348 may extend into an interior of the door 304 via a suitable aperture or slot formed within the flange 374. As such, a mounting surface of the support bracket 310 may rest flush against the flange 374 in the installed configuration 370 of the upper restrictor assembly 362.

Figure 22:
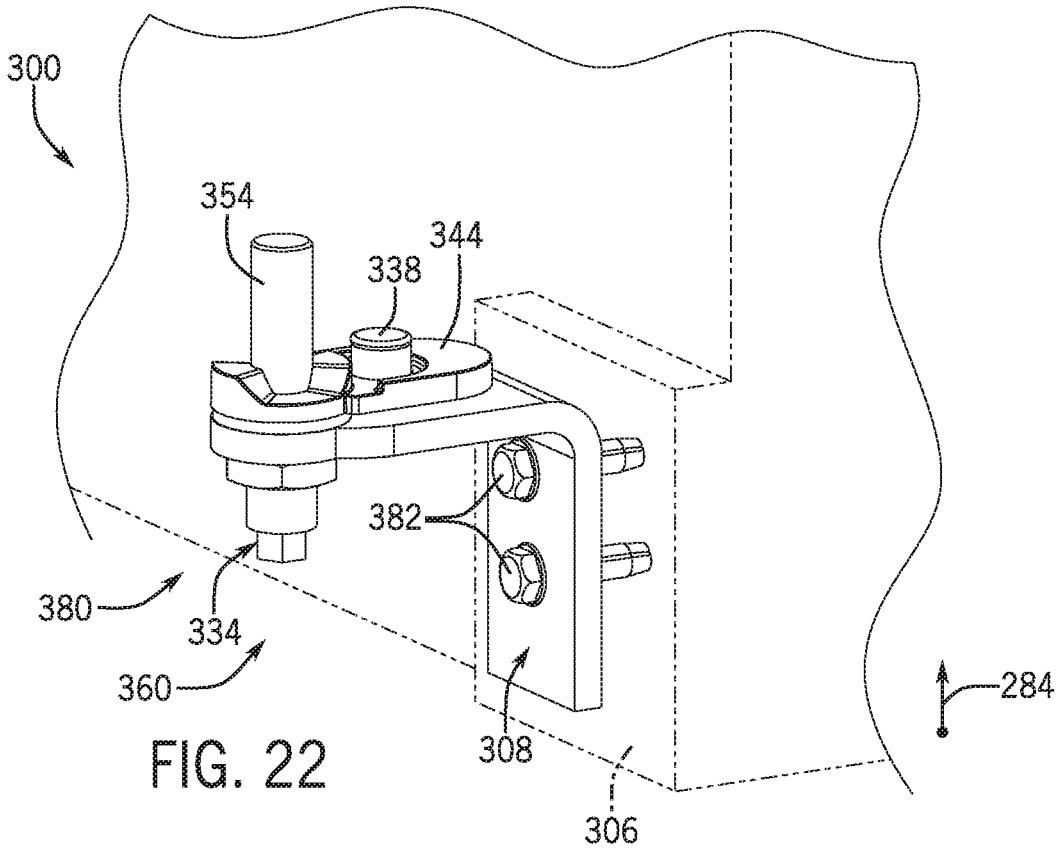
FIG. 22 is a perspective view of an embodiment of a portion of an electrical box having a bracket assembly of a panel restrictor, in accordance with an aspect of the present disclosure.

FIG. 22 is a perspective view of an embodiment of a portion of the electrical box 300, illustrating the lower restrictor assembly 360 in an installed configuration 380 on the frame 306. As shown in the illustrated embodiment, suitable fasteners 382 may be used couple the frame bracket 308 to the frame 306. It should be appreciated that, in the installed configuration 380 of the lower restrictor assembly 360, the shaft 354 of the guide pin 334 may extend from the frame bracket 308 in a generally upward direction 284, with respect to gravity.

Figure 23:
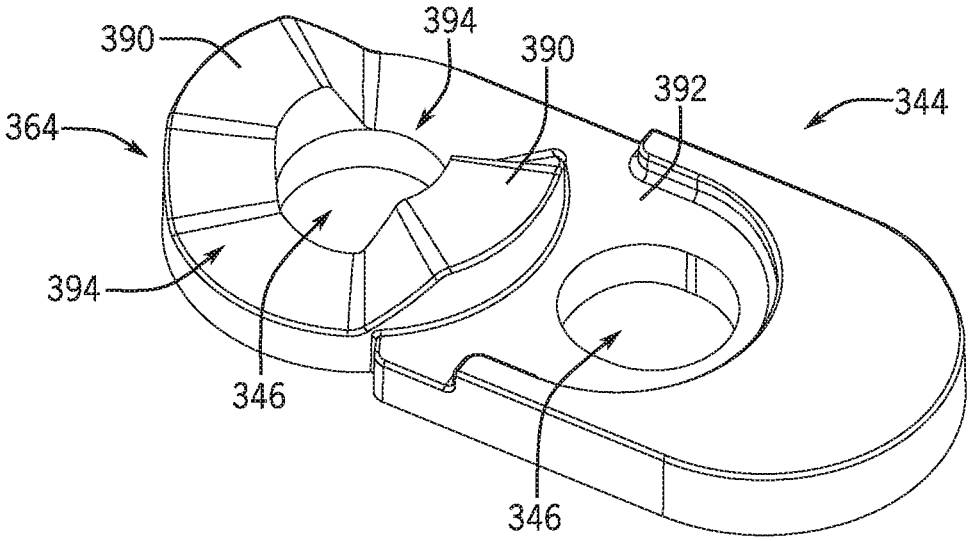
FIG. 23 is a perspective view of an embodiment of a cam for a panel restrictor, in accordance with an aspect of the present disclosure.

FIG. 23 is a perspective view of an embodiment of the lower cam 344. The lower cam 344 includes the first lobed profile 364 that extends about one of the apertures 346. The first lobed profile 364 may be defined by a first plurality of protrusions 390 that extend from a body 392 of the lower cam 344 and by a first plurality of grooves 394 that are positioned between each of the first plurality of protrusions 390. Although the lower cam 344 includes two protrusions 390 in the illustrated embodiment, in other embodiments, the lower cam 344 may include 2, 3, 4, 5, 6, or more than 6 protrusions 390 that define the first lobed profile 364. The number of protrusions 390 may correlate with a number of discrete positions or orientations at which the third panel restrictor 302 may retain the door 304.

As noted above, the first lobed profile 364 is configured to engage with the second lobed profile 366 of the upper cam 348. For example, to better illustrate and to facilitate the following discussion, FIG. 24 is a perspective view of an embodiment of the upper cam 348. Similar to the lower cam 344, the upper cam 348 includes the second lobed profile 366 that extends about an opening of the cylindrical cavity 352. The second lobed profile 366 may be defined by a second plurality of protrusions 400 that extend from a body 402 of the upper cam 348 and by a second plurality of grooves 404 that are positioned between each of the second plurality of protrusions 400. A quantity of the second plurality of protrusions 400 may correspond to a quantity of the first plurality of protrusions 390. Accordingly, although the upper cam 348 includes two protrusions 400 in the illustrated embodiment, in other embodiments, the upper cam 348 may include 2, 3, 4, 5, 6, or more than six protrusions 400 that define the second lobed profile 366.

Figure 25:
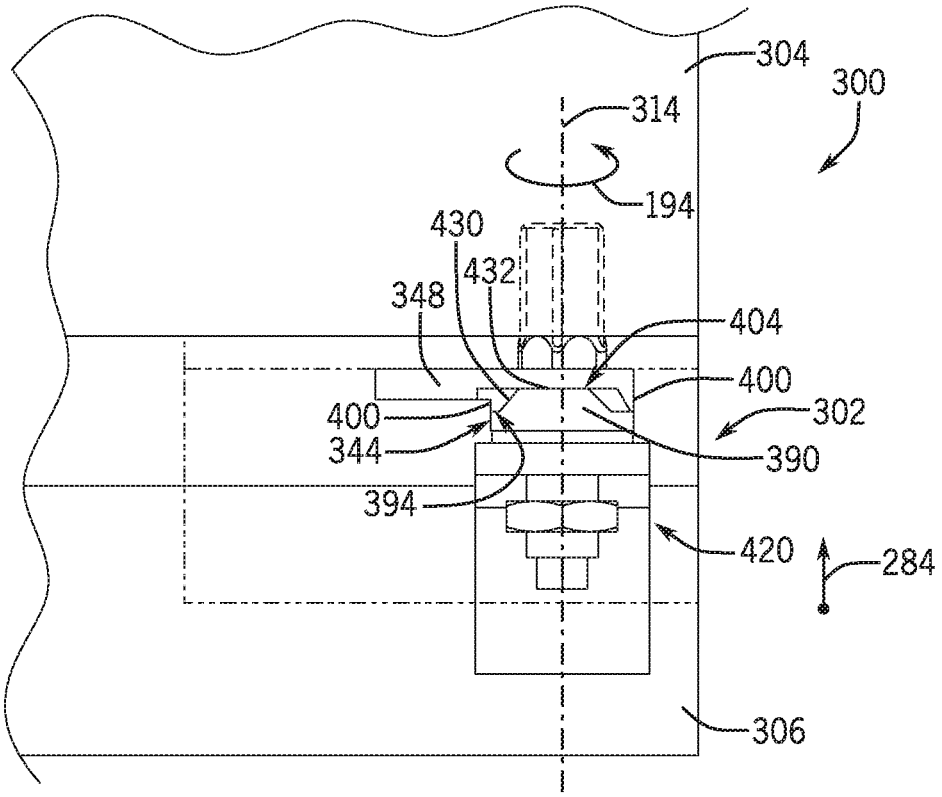
FIG. 25 is a side view of an embodiment of a portion of an electrical box having a panel restrictor, in accordance with an aspect of the present disclosure.

FIG. 25 is a side view of an embodiment of a portion of the electrical box 300, illustrating the third panel restrictor 302 positioned in a first configuration 420. In the first configuration 420, the third panel restrictor 302 may retain the door 304 in the closed position 320. For example, when the third panel restrictor 302 is in the first configuration 420, the first plurality of protrusions 390 of the lower cam 344 may be positioned in the second plurality of grooves 404 of the upper cam 348, and the second plurality of protrusions 400 of the upper cam 348 may be positioned in the first plurality of grooves 394 of the lower cam 344. The engagement between the first plurality of protrusions 390 and the second plurality of grooves 404, and between the second plurality of protrusions 400 and the first plurality of grooves 394, may inhibit free rotation of the upper cam 348, relative to the lower cam 344, about the axis 314. Accordingly, the third panel restrictor 302 may block movement of the door 304 and ensure that the door 304 does not pivot from the closed position 320 to an open position when, for example, wind is impinging against the electrical box 300 and imparting a force on the door 304.

Figure 26:
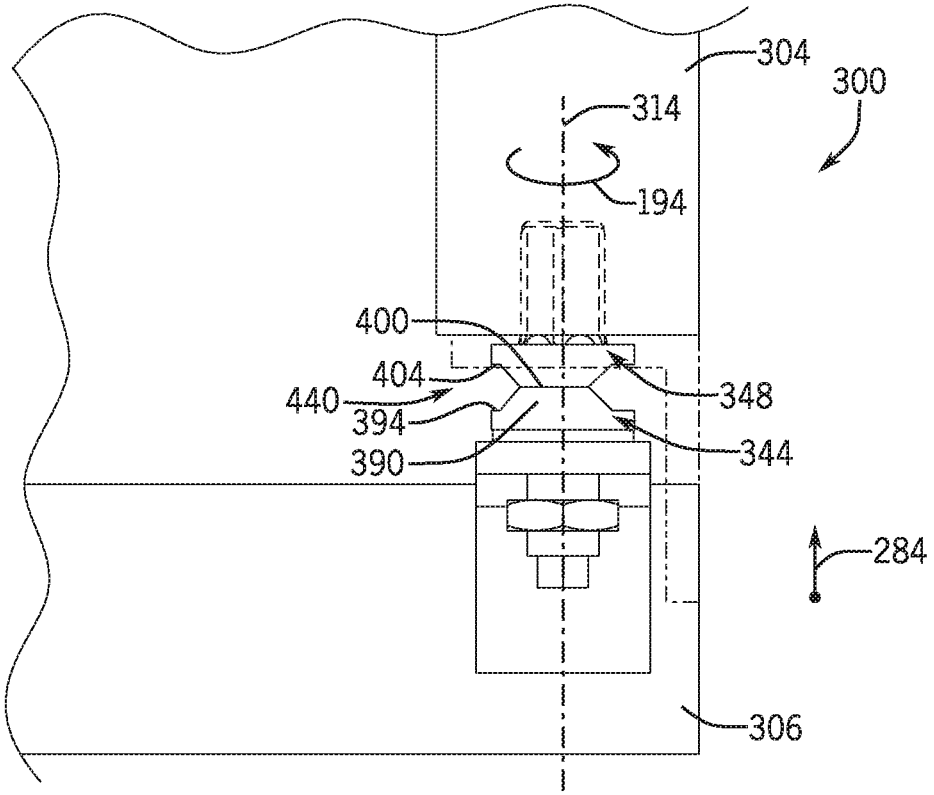
FIG. 26 is a side view of an embodiment of a portion of an electrical box having a panel restrictor, in accordance with an aspect of the present disclosure.

To transition the door 304 from the closed position 320 to an open position, an operator may grab the door 304, such as via a handle of the door 304, and may rotate the door 304 about the axis 314 in the counter-clockwise direction 194 with sufficient force to cause the second plurality of protrusions 400 to translate along an inclined surface 430 of the first plurality of protrusions 390 and onto an upper surface 432 of the first plurality of protrusions 390. Indeed, rotational movement of the upper cam 348 in the counter-clockwise direction 194 about the axis 314, relative to the lower cam 344, may force the upper cam 348 in the upward direction 284 due to the engagement between the first and second lobed profiles 364, 366. As such, the upper cam 348 may force the upper restrictor assembly 362, and thus the door 304, in the upward direction 284 during rotation of the upper cam 348 relative to the lower cam 344. It should be appreciated that the engagement between the shaft 354 of the guide pin 334 and the cylindrical cavity 352 of the upper cam 348 may guide the axial movement of the upper cam 348 along the axis 314. Moreover, it should be understood that sufficient clearance along the axis 314 is provided between the frame 306 or housing of the electrical box 300 and the door 304 to ensure that axial movement of the door 304 along the axis 314 does not result in interference between the door 304 and other components of the electrical box 300. As such, the operator may cause the third panel restrictor 302 to transition from the first configuration 420 to an intermediate configuration 440, as shown in FIG. 26, by rotating the door 304 about the axis 314 with sufficient force to cause the upper cam 348 to move a weight of the door 304 in the upward direction 284 by a height of the first plurality of protrusions 390.

Figure 27:
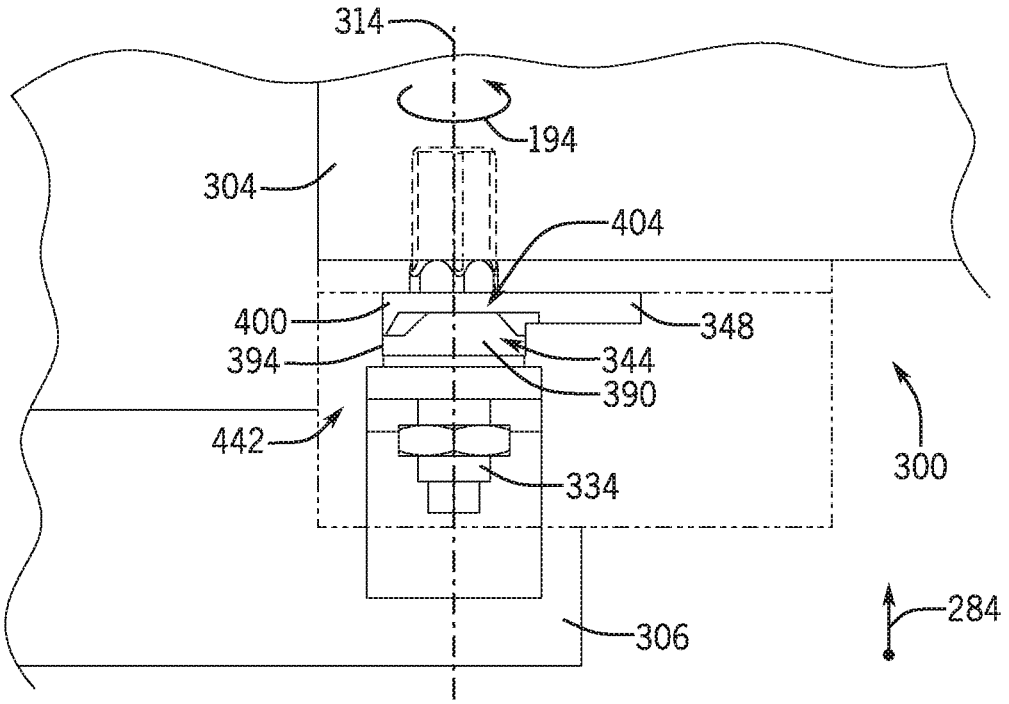
FIG. 27 is a side view of an embodiment of a portion of an electrical box having a panel restrictor, in accordance with an aspect of the present disclosure.

Upon transitioning the third panel restrictor 302 to the intermediate configuration 440, the operator may continue to rotate the door 304 in the counter-clockwise direction 194 about the axis 314 until the first plurality of protrusions 390 of the lower cam 344 re-engage with the second plurality of grooves 404 of the upper cam 348, and the second plurality of protrusions 400 of the upper cam 348 re-engage with the first plurality of protrusions 390 of the lower cam 344. That is, the operator may continue to rotate the door 304 in the counter-clockwise direction 194 about the axis 314 until the third panel restrictor transitions to a second configuration 442, as shown in FIG. 27. The operator may transition the door 304 from the open position back to the closed position 320 by performing the aforementioned steps in reverse order.

It should be understood that a force utilized to lift a weight of the door 304, when transitioning the third panel restrictor 302 from the first or second configurations 420, 442 to the intermediate configuration 440, may be greater than, for example, a force acting on the door 304 due to wind impinging on the door 304 or due to other inadvertent contact with the door 304. Accordingly, the third panel restrictor 302 may be configured to retain the door 304 in the closed position 320 or in an open position until an operator adjusts a position of the door 304. Moreover, as noted above, it should be understood that increasing a quantity of the first plurality of protrusions 390 and a quantity of the second plurality of protrusions 400 may increase a quantity of discrete positions at which the third panel restrictor 302 may retain the door 304. Accordingly, the third panel restrictor 302 may be used to retain the door 304 in the closed position 320, in an open position, or in a plurality of intermediate positions between such open and closed positions.

In some embodiments, the guide pin 334, the lower cam 344, and/or the upper cam 348 may be formed from a polymeric material. For example, the guide pin 334, the lower cam 344, and/or the upper cam 348 may be formed from an injection molding process or via another suitable manufacturing process. As such, the guide pin 334, the lower cam 344, and the upper cam 348 may substantially block electric current flow across the pivoting assembly 312. Accordingly, the third panel restrictor 302 may mitigate electrical discharge from the frame 306 to the door 304 or vice versa.

As set forth above, embodiments of the present disclosure may provide one or more technical effects useful for retaining a panel assembly or a door of an HVAC enclosure in a particular position. Particularly, the embodiments of the panel restrictors 120 disclosed herein facilitate retaining panel assemblies or other doors in various open positions without input from personnel using to doors. As such, the panel restrictors 120 may facilitate performance of maintenance, inspection, or other operations on an HVAC system. It should be understood that the technical effects and technical problems in the specification are examples and are not limiting. Indeed, it should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A panel restrictor for a heating, ventilation, and/or air conditioning (HVAC) unit, comprising:

a first bracket configured to couple to a structural support of the HVAC unit, wherein the first bracket includes a slot;

a second bracket configured to couple to a panel of the HVAC unit, wherein the second bracket includes an arcuate segment configured to extend through the slot and a mounting flange extending cross-wise to the arcuate segment, wherein the mounting flange is configured to mount to the panel; and an engager configured to secure the arcuate segment within the slot at a plurality of discrete positions along the arcuate segment.

2. The panel restrictor of claim 1, wherein the engager includes a bolt configured to engage with the first bracket and the second bracket to secure the arcuate segment within the slot at the plurality of discrete positions.

3. The panel restrictor of claim 2, wherein the arcuate segment includes a plurality of apertures formed therein, wherein each aperture of the plurality of apertures corresponds with a respective discrete position of the plurality of discrete positions.

4. The panel restrictor of claim 3, wherein the bolt extends through one of the plurality of apertures at a corresponding one of the plurality of discrete positions.

5. The panel restrictor of claim 2, wherein the first bracket includes a nut coupled to the bolt and configured to support the bolt during movement of the arcuate segment within the slot.

6. The panel restrictor of claim 5, wherein the first bracket includes a first flange and a second flange extending cross-wise to the first flange, wherein the nut is secured to the first flange and the second flange is configured to mount to the structural support of the HVAC unit.

7. The panel restrictor of claim 1, wherein the panel includes an inner wall configured to face an interior of the HVAC unit and an outer wall configured to face an environment surrounding the HVAC unit, wherein the mounting flange is configured to mount to the inner wall.

8. The panel restrictor of claim 1, wherein the first bracket and the second bracket are each single-piece components.

9. A heating, ventilation, and/or air conditioning (HVAC) unit, comprising:

a panel pivotably coupled to a structural support of the HVAC unit; and a panel restrictor configured to retain the panel in a plurality of orientations relative to the structural support, wherein the panel restrictor includes:

a first bracket fixedly coupled to the structural support and including a slot;

a second bracket fixedly coupled to the panel and including an arcuate segment extending through the slot; and an engager configured to secure the arcuate segment within the slot at a plurality of discrete positions along the arcuate segment, wherein each of the plurality of discrete positions corresponds to one of the plurality of orientations of the panel.

10. The HVAC unit of claim 9, comprising a hinge assembly pivotably coupling the panel to the structural support and enabling the panel to pivot about an axis relative to the structural support.

11. The HVAC unit of claim 10, wherein a radial dimension from the axis to an edge of the arcuate segment is constant along a length of the edge.

12. The HVAC unit of claim 10, wherein the hinge assembly is one of a plurality of hinge assemblies, wherein the plurality of hinge assemblies supports a weight of the panel such that the panel restrictor does not support the weight of the panel.

13. The HVAC unit of claim 9, wherein the first bracket includes a first flange and a second flange extending cross-wise to the first flange, wherein the first flange includes the slot and is coupled to the structural support.

14. The HVAC unit of claim 13, wherein the engager includes a nut coupled to the second flange and a bolt supported by the nut, wherein the bolt is configured to engage with the second bracket to secure the arcuate segment within the slot at the plurality of discrete positions.

15. The HVAC unit of claim 14, wherein the arcuate segment includes a plurality of apertures formed therein, wherein each aperture of the plurality of apertures corresponds with a respective discrete position of the plurality of discrete positions, and wherein the bolt is configured to extend through one of the plurality of apertures at a corresponding one of the plurality of discrete positions.

16. The HVAC unit of claim 9, wherein the panel includes an inner wall facing an interior of the HVAC unit and an outer wall facing an ambient environment surrounding the HVAC unit, wherein the second bracket includes a mounting flange extending cross-wise to the arcuate segment, and wherein the mounting flange is coupled to the inner wall of the panel.

17. A door assembly of a heating, ventilation, and/or air conditioning (HVAC) unit, comprising:

a panel configured to occlude an opening of the HVAC unit;

a hinge pivotably coupling the panel to a structural support of the HVAC unit and enabling pivotal motion of the panel about an axis relative to the structural support; and a panel restrictor configured to retain the panel in a plurality of orientations relative to the structural support, wherein the panel restrictor includes:

a first bracket coupled to the structural support and including a slot;

a second bracket coupled to the panel and including an arcuate segment configured to extend through the slot, wherein the arcuate segment includes a plurality of apertures formed therein; and an engager coupled to the first bracket and configured to engage with an aperture of the plurality of apertures to secure the first bracket to the second bracket at a discrete position along the arcuate segment, wherein the discrete position corresponds to one of the plurality of orientations of the panel.

18. The door assembly of claim 17, wherein the first bracket includes a first flange and a second flange extending generally cross-wise to the first flange, wherein the first flange is coupled to the structural support and includes the slot, and wherein the second flange supports the engager.

19. The door assembly of claim 18, wherein the engager includes a nut coupled to the second flange and a bolt coupled to and supported by the nut, wherein the bolt is configured to engage with the aperture of the plurality of apertures to couple the first bracket to the second bracket at the discrete position.

20. The door assembly of claim 17, wherein the panel includes an inner wall configured to face an interior of the HVAC unit and an outer wall configured to face an environment surrounding the HVAC unit, wherein the second bracket is coupled to the inner wall of the panel.

21. The door assembly of claim 17, wherein the first bracket and the second bracket are single-piece components formed from sheet metal.

22. The door assembly of claim 17, wherein the hinge is one of a plurality of hinges, wherein the plurality of hinges is configured to support a weight of the panel such that the panel restrictor does not support the weight of the panel.

23. The door assembly of claim 17, wherein the arcuate segment is configured to travel along a circumferential path about the axis as the panel pivots about the axis.

* * * * *